US005107757A

United States Patent [19]

Ohshita et al.

[11] Patent Number: 5,107,757

[45] Date of Patent: Apr. 28, 1992

[54] APPARATUS FOR DEWATERING WASTE MATERIAL BY CAPILLARY ACTION

[75] Inventors: Takahiro Ohshita, Yokohama; Ryuichi Ishikawa, Tokyo; Tetsuhisa Hirose, Tokyo; Kiyoshi Asai, Tokyo, all of Japan

[73] Assignees: Ebara Corporation, Tokyo; Ibiden Co., Ltd., Ogaki, both of Japan

[21] Appl. No.: 251,648

[22] PCT Filed: Dec. 26, 1986

[86] PCT No.: PCT/JP86/00659

§ 371 Date: Jun. 3, 1988

§ 102(e) Date: Jun. 3, 1988

[87] PCT Pub. No.: WO87/04114

PCT Pub. Date: Jul. 16, 1987

[30] Foreign Application Priority Data

| | | | |
|---|---|---|---|
| Dec. 30, 1985 | [JP] | Japan | 60-298275 |
| Jul. 14, 1986 | [JP] | Japan | 61-165180 |
| Aug. 15, 1986 | [JP] | Japan | 61-190474 |

[51] Int. Cl.[5] ..... B30B 9/00; B30B 9/20

[52] U.S. Cl. ..... 100/90; 100/112; 100/121; 210/386; 210/391

[58] Field of Search ..... 100/37, 90, 104, 106, 100/110, 112, 121; 210/386, 391, 402

[56] References Cited

U.S. PATENT DOCUMENTS

| | | | |
|---|---|---|---|
| 949,787 | 2/1910 | Wheat | 100/121 |
| 1,032,167 | 7/1912 | Vernsten | 100/121 X |
| 1,194,266 | 8/1916 | Alvord | 100/121 |
| 1,834,852 | 12/1931 | Kutter | 100/121 |
| 2,209,759 | 7/1940 | Berry | 100/112 X |
| 2,798,424 | 7/1957 | Smith et al. | 100/121 X |
| 3,217,387 | 11/1965 | Strindlund | 100/121 X |
| 3,364,103 | 1/1968 | Kusters | 100/121 X |
| 3,447,451 | 6/1969 | Meskanen | 100/121 |
| 3,468,242 | 9/1969 | Schaffrath | 100/121 |
| 4,378,253 | 3/1983 | Bouvet | 100/121 X |

FOREIGN PATENT DOCUMENTS

| | | |
|---|---|---|
| 53-44701 | 11/1978 | Japan . |
| 54-46848 | 3/1979 | Japan . |
| 55-5737 | 1/1980 | Japan . |
| 55-5738 | 1/1980 | Japan . |
| 57-58415 | 4/1982 | Japan . |
| 57-55389 | 11/1982 | Japan . |
| 58-131112 | 8/1983 | Japan . |
| 58-176100 | 10/1983 | Japan . |
| 60-43839 | 9/1985 | Japan . |

*Primary Examiner*—Harvey C. Hornsby
*Assistant Examiner*—Stephen F. Gerrity
*Attorney, Agent, or Firm*—Wenderoth, Lind & Ponack

[57] ABSTRACT

A method of and apparatus for dewatering a substance which is to be dewatered such as sludge wherein the substance to be dewatered is pressed between a pair of rollers (11, 212) or plate-shaped press members (331) each having its press surface formed from a rigid porous material (6, C, 331) having water absorption and retention properties based on the capillary action; water squeezed from the substance by pressing is permeated into the rigid porous material due to water absorption based on the capillary action or water pressure and the permeated water is retained by virtue of the water retention properties based on the capillary action, thereby dewatering the substance; and the water retained by the rigid porous material is discharged by sending pressurized air to regenerate the capillary tubes.

11 Claims, 22 Drawing Sheets

APPARATUS FOR DEWATERING WASTE MATERIAL BY CAPILLARY ACTION

TECHNICAL FIELD

The present invention relates to a press type dewatering method and apparatus for separating liquid and solid contents from various kinds of suspension and solid-liquid mixture containing various kinds of substances such as organic and inorganic substances, for example, industrial waste water, human waste, sewage sludge, raw materials for pulp, waste liquors, spent grains or the like.

BACKGROUND ART

Examples of machines for dewatering suspensions which contain substances whose particles are so fine that it is difficult to dewater them, such as sewage sludge, generally include various kinds of dehydrators such as vacuum dehydrators, centrifugal dehydrators, filter presses and belt presses. However, the dewatering performances of vacuum dehydrators, centrifugal dehydrators and the like are limited to a water content of about 80%, dehydrators for suspensions which are difficult to dewater there are now generally used filter presses and belt presses.

Belt presses are arranged such that about ten or more rolls are combined to stretch two filter, cloths having a mesh size of about 0.5 mm or less in such a manner that the filter cloths are able to travel, and a suspension which is passed between the filter cloths is pressed so as to be dewatered by means of a tensile force of the belts. However, such belt presses suffer from the problem that the filter cloths become clogged, thus involving troublesome maintenance.

In dehydration of suspensions which are difficult to dewater, it is general practice for improving the dewatering performance to add a polymeric flocculating agent or the like to a suspension, thereby flocculating particles therein and thus effecting dehydration. But still the water content after the dehydration is said to be generally limited to 70%.

In countries, particularly those which have limited land spaces, disposal of various kinds of sludge now becomes a problem, and there is a question as to how the use of reclaimed lands can be ensured in several years' time. For this reason, the disposal of sewage sludge is gradually being carried out more frequently by the volume reduction treatment in which the volume of sewage sludge is reduced by thermal disposal.

In the case of thermal disposal of sludge, the water content at which self-burning can take place, that is, at which sludge itself can burn without the need of an assisting fuel oil such as heavy oil, is from 65% to 70% for sewage sludge, although such water content depends on the kinds of sludge. However, since existing dehydrators do not have the capacity for dewatering sewage sludge to a water content at which it is able to self-burn, the fact is that sludge is subjected to thermal disposal with an assist from an oil such as heavy oil (about 100 l per ton of sludge), which means that disposal of sludge involves high costs. Because of the desire to conserve energy, those skilled in the art set the goal at incinerating sludge without using any oil, and various kinds of sludge incinerating systems have already been developed for the purpose of saving and creating energy. Principal examples of such systems include those wherein pulverized coal is added to sludge in order to obtain a higher heating value, those which utilize waste tires, and those which involve thickening by evaporation, drying, high-concentration dehydration, etc., and the sludge drying system has gradually become the most commonly used of the sludge incinerating systems. The sludge drying system is arranged such that a waste heat boiler is installed to dry sludge by means of steam so that the sludge becomes able to self-burn, but the system has the disadvantage that the installation cost is gigantic. Therefore, the appearance of a dehydrator which has a simple system arrangement and is still able to perform highly efficient dehydration is eagerly awaited, and dehydrators obtained by variously improving the above-described belt press which is the simplest system have already appeared.

One example of the above-described conventional dewatering apparatus is schematically shown in FIG. 18. This dewatering apparatus is arranged such that filter members 55 which are provided with a multiplicity of small bores for defining filtrate passages are disposed in opposing relation to each other, and a substance which is to be dewatered, such as sludge, is press-dewatered between the filter members 55 by means of a press 56. Since it is possible to press sludge or the like directly by the opposing surfaces of the filter members 55 and since it is inconvenient to load sludge or the like into the area between the filter members 55 and to unload dewatered cake, filter cloths which are used in belt presses are employed as an upper filter cloth 57 and a lower filter cloth 58 which are disposed in opposing relation to each other and in such a manner that they are able to travel intermittently. A substance 60 which is to be dewatered is supplied onto the lower filter cloth 58 from a dewatered substance introducing hopper 59 and then pressed by the filter members 55 through the upper and lower filter cloths 57 and 58, thereby removing water from the substance to be dewatered. However, this apparatus has the disadvantage that, since strong pressing force is applied to thin filter cloths, the filter are severely damaged.

The greatest disadvantage of the above-described conventional dewatering apparatus is that openings (filtrate passages) in the filter cloths are clogged with sludge to resist the passage of filtrate and this makes impossible to effect dehydration, and that, since strong pressure causes sludge to come through the openings in the filter cloths, it is necessary to add a powder having water permeability (e.g., burned ash) to a substance to be dewatered in order to increase the particle size and raise the viscosity. However, addition of such powder increases the amount of substance to be dewatered, such as sludge, and even if the water content of dewatering cake obtained after dehydration is lowered by a large margin, the lowering in the water content is only an observed phenomenon.

For instance, if it is assumed that 20% of a powder is added to sludge as a raw material which is to be dewatered and which has a water content of 80% and the water content after dehydration is 50%, the actual amount of solid content and the actual water content are as follows. In order to facilitate understanding, it is assumed that the amount of a raw material sludge having a water content of 80% is 100 kg/h. In such case, the amount of solid content in the raw material sludge $=100\ kg/h \times 0.2 = 20\ kg/h$; the amount of water content at the time when the water content is 80% = 100 kg/h×0.8=80 kg/h; and the amount of added powder=10 kg/h×0.2=20 kg/h. If the amount of water content after dehydration is represented by W, $$W=40kg/h$$

from the following equation:

$$\{1-(20kg/h+20kg/h)/(20kg/h+20kg/h+W)\}\times 100=50\%$$

Accordingly, the actual water content with respect to only the solid content in the raw material sludge is as follows:

$$\{1-(20kg/h)/(20kg/h+40kg/h)\}\times 100=67\%$$

In other words, even if the apparent water content is 50%, the actual water content is only about 67%. When the ratio of addition is 10%, the actual water content is found to be 60% by a similar calculation.

Further, since the amount of solid content after dehydration is 40 kg/h and the amount of water content is 40 kg/h, the reduction in volume of the sludge having a water content of 50% is only 80%.

FIG. 19 shows another conventional example wherein a substance 60 to be dewatered which is contained in a tank 61 is subjected to strong press by means of a pressure 56 in a manner similar to that in the apparatus shown in FIG. 18. In the example shown in FIG. 19, fixed filter cloths 62 (or wire nets having a multiplicity of interstices) are employed in place of the movable filter cloths shown in FIG. 18. This example also involves disadvantages similar to those described above and further has the drawback that, since the filter cloths cannot be washed, they cannot endure a long-term service.

In addition, the conventional apparatus wherein a substance to be dewatered is pressed so as to be dewatered by means of a pair of press members has the disadvantage that water which has been removed from the dewatered substance is sucked back into the substance by the effect of a vacuum produced after the substance has been released from pressing force.

One example of the vacuum type dewatering apparatus is disclosed in the specification of Japanese Patent Publication No. 44701/1978, and one example of the dewatering apparatus utilizing the capillary action is disclosed in the specification of Japanese Patent Laid-Open No. 5737/1980, but the dewatering capacity of these conventional apparatuses is limited.

The present invention aims at solving the above-described problems of the prior art and its object is to provide a dewatering method and apparatus therefor wherein a substance which is to be dewatered is pressed by press members each having its press surface formed from a rigid porous material having water absorption and retention properties based on the capillary action to squeeze water from the substance to be dewatered, and the squeezed water is permeated into the rigid porous material to effect dehydration.

Another object of the present invention is to provide a dewatering method and apparatus therefor wherein a sludgy substance which is to be dewatered, such as sludge, is confined in a predetermined space, and while doing so, it is pressed by press members each having its press surface formed from a rigid porous material having water absorption and retention properties based on the capillary action to squeeze water from the substance to be dewatered, and the squeezed water is permeated into the rigid porous material in association with water pressure, thereby effecting dehydration and thus obtaining dewatered cake having a low water content.

DISCLOSURE OF THE INVENTION

In order to attain the foregoing objects, the present invention provides a dewatering method wherein a substance which is to be dewatered, such as sludge, is pressed by a pair of press members the press surface of at least one of which is formed from a rigid porous material having water absorption and retention properties based on the capillary action to squeeze water from the substance to be dewatered, and the squeezed water is permeated into the rigid porous material so as to be retained thereby.

The present invention further provides a dewatering method wherein, in addition to the above-described method, the water permeated into and retained by the rigid porous material is discharged by utilizing pressurized air or the like, thereby regenerating the capillary tubes.

Further, the present invention provides a dewatering method wherein a substance which is to be dewatered is pressed by a pair of opposing press rolls which are rotated in close proximity with each other and at least one of which is defined by a hollow cylindrical dewatering roll having its press surface formed from a rigid porous material having water absorption and retention properties based on the capillary action, and while doing so, water which is squeezed by the pressing is permeated into the rigid porous material of the dewatering roll, thereby dewatering the substance, and after dewatering cake adhering to the press rolls has been separated, pressurized air is supplied into the inside of the hollow cylindrical dewatering roll to discharge water retained by the rigid porous material, thus regenerating the porous material.

Further, the present invention provides a dewatering method wherein a sludgy substance which is to be dewatered, such as sludge, is confined in a predetermined space, and while doing so, it is pressed by a pair of press members the press surface of at least one of which is formed from a rigid porous material having water absorption and retention properties based on the capillary action to squeeze water from the substance to be dewatered, and the squeezed water is permeated into the rigid porous material in association with water pressure, thereby allowing the squeezed water to replace water retained by the rigid porous material and dewatered the substance and thus obtaining dewatering cake having a low water content.

In order to attain the foregoing objects, the present invention provides a dewatering apparatus in which a substance which is to be dewatered is press-dewatered between a pair of press members disposed in opposing relation to each other, characterized in that the press surface of at least one of the press members is formed from a rigid porous material having water absorption and retention properties based on the capillary action.

Further, the present invention provides a dewatering apparatus wherein the above-described apparatus is further provided with a capillary regenerating means for discharging water retained by the rigid porous material.

Further, the present invention provides a press-dewatering apparatus comprising: a press section where a substance which is to be dewatered is pressed by at least two rolls having their surfaces formed from a rigid porous material having water absorption and retention properties based on the capillary action; a flexible frame member defining a multiplicity of storage portions for storing the substance to be dewatered, the frame member being passed through the press section; and a dewatered substance supply section for filling the substance to be dewatered into the storage portions.

Further, the present invention provides a dewatering roll which may be employed in the above-described dewatering apparatuses, characterized in that a rigid porous material having water absorption and retention properties based on the capillary action and having a predetermined thickness is formed on the outer peripheral surface of a cylindrical member having a multiplicity of small through-bores formed in its outer peripheral surface.

Further, the present invention provides a dewatering apparatus in which a substance which is to be dewatered is press-dewatered between press members disposed in opposing relation to each other, characterized in that the press members are defined by plate-shaped press members at least one of the opposing surfaces of which is provided with a layer of a rigid porous material having water absorption and retention properties based on the capillary action, the press members being respectively provided with compressible frame members which are fitted with each other when the press members approach each other to a predetermined spacing in such a manner that the frame members surround a predetermined range on the press surfaces so as to shut it off from the outside.

BRIEF DESCRIPTION OF THE DRAWINGS

FIGS. 36 to 39 are views illustrating a seventeenth embodiment of the present invention, in which FIG. 36 is a schematic view illustrating the general arrangement thereof, and FIGS. 37 and 38 are a sectional side view and a partially-sectioned view, respectively, of one filter plate.

BEST MODE FOR CARRYING OUT THE INVENTION

A mode for carrying out the present invention will be described hereinunder with reference to the drawings.

In the dewatering method and apparatus therefor according to the present invention, a substance which is to be dewatered is pressed by a pair of press members having press surfaces formed from a rigid porous material having a large compressive strength, such as a porous ceramics, and the substance is dewatered by utilizing the water absorption and retention properties of the rigid porous material based on the capillary action. Therefore, the relationship between the water absorbing action (the speed of water absorption) of the rigid porous material by the capillary action, the pneumatic pressure and the water draining action (the water draining speed) will first be described for porous ceramics as one example.

Figure 15:
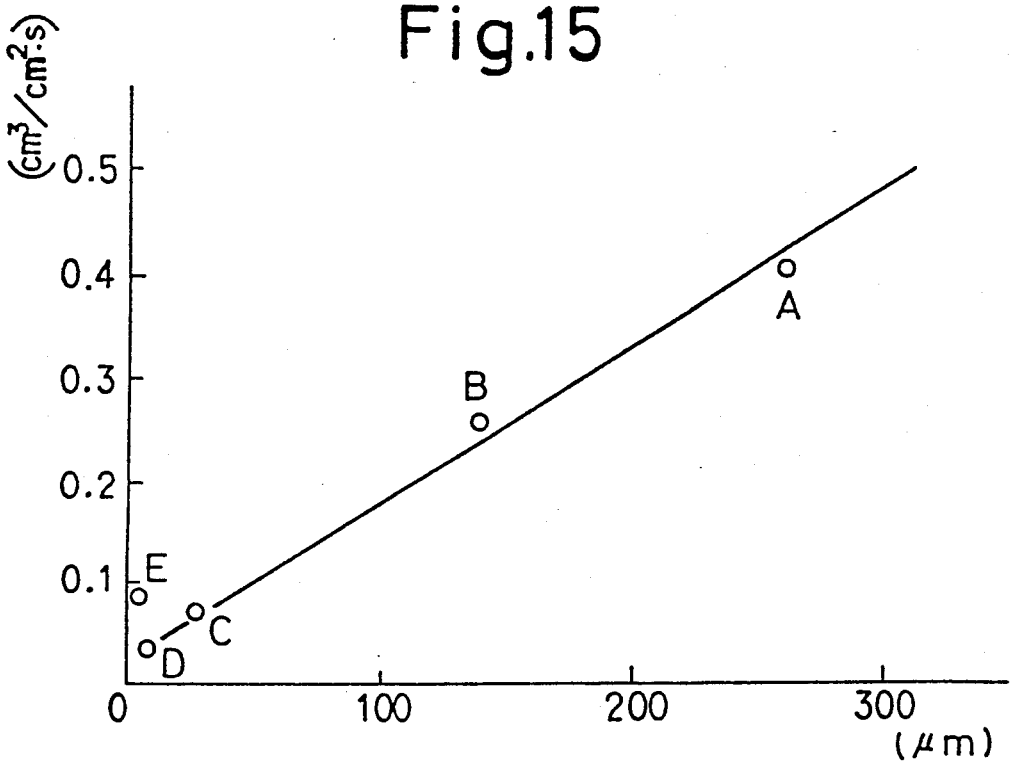
FIG. 15 is a chart illustrating the relationship between various mean pore diameters of porous ceramics and the speed of water absorption.

FIG. 15 shows the experimentally obtained relationship between the mean pore diameter ($\mu$m) of porous ceramics and the speed of water absorption. In the figure, the ordinate represents the water absorption speed ($cm^3/cm^2 \cdot S$), and the abscissa represents the mean pore diameter. As porous ceramics, porous silicon carbide ($\beta$-SiC) plates were employed, the plates respectively having the following mean pore diameters:

| | |
|---|---|
| A: 260 μm | |
| B: 140 μm | |
| C: 26 μm | |
| D: 8 μm | |
| E: 140 μm (parent body) + 4 μm (surface thin film) | |

As will be understood from FIG. 15, the water absorption speed is substantially proportional to the mean pore diameter, that is, the larger the mean pore diameter, the higher the water absorption speed, but as to ceramic E, although the mean pore diameter at the surface is relatively small, i.e., 4 μm, it is possible to obtain a water absorption speed corresponding to that for a mean pore diameter of 40 μm, which means that a thin film enables the mean pore diameter in the surface to be reduced while maintaining the water absorption speed at a certain level.

Figure 16:
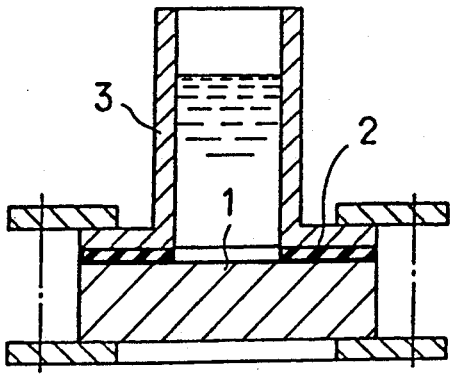
FIG. 16 is a sectional view illustrating a measuring apparatus for measuring the speed of water absorption shown in FIG. 15.

It should be noted that the numerical values for the water absorption speed were measured in the manner as shown in FIG. 16, in which each of the porous ceramic plates 1 having various mean pore diameters was brought into close contact with a transparent acrylic pipe 3 through a seat packing 2, and an amount of water which corresponds to the maximum water absorption was introduced from the upper end of the transparent acrylic pipe 3 to measure the time required for the water to be completely absorbed.

As to the water absorption time, the required water absorption time t in the case of, for example a water absorption speed of 0.1 $cm^3/cm^2 \cdot S$ and a porosity of 40% is represented as follows (when the plate thickness of the porous ceramic plate 1 is 10 mm):

$$t = (1\ cm^3/cm^2 \times 0.4)/(0.1\ cm^3/cm^2 \cdot S)$$
$$= 4 \text{ seconds (water absorption: 100\%)}$$

Accordingly, if the water absorption and retention is assumed to be 50%, t is about 2 seconds. In other words, it is possible to absorb water within an extremely short period of time.

The following is a description of discharging of water retained in porous ceramic plates by means of pneumatic pressure, that is regeneration of capillary tubes by means of pneumatic pressure.

Figure 17:
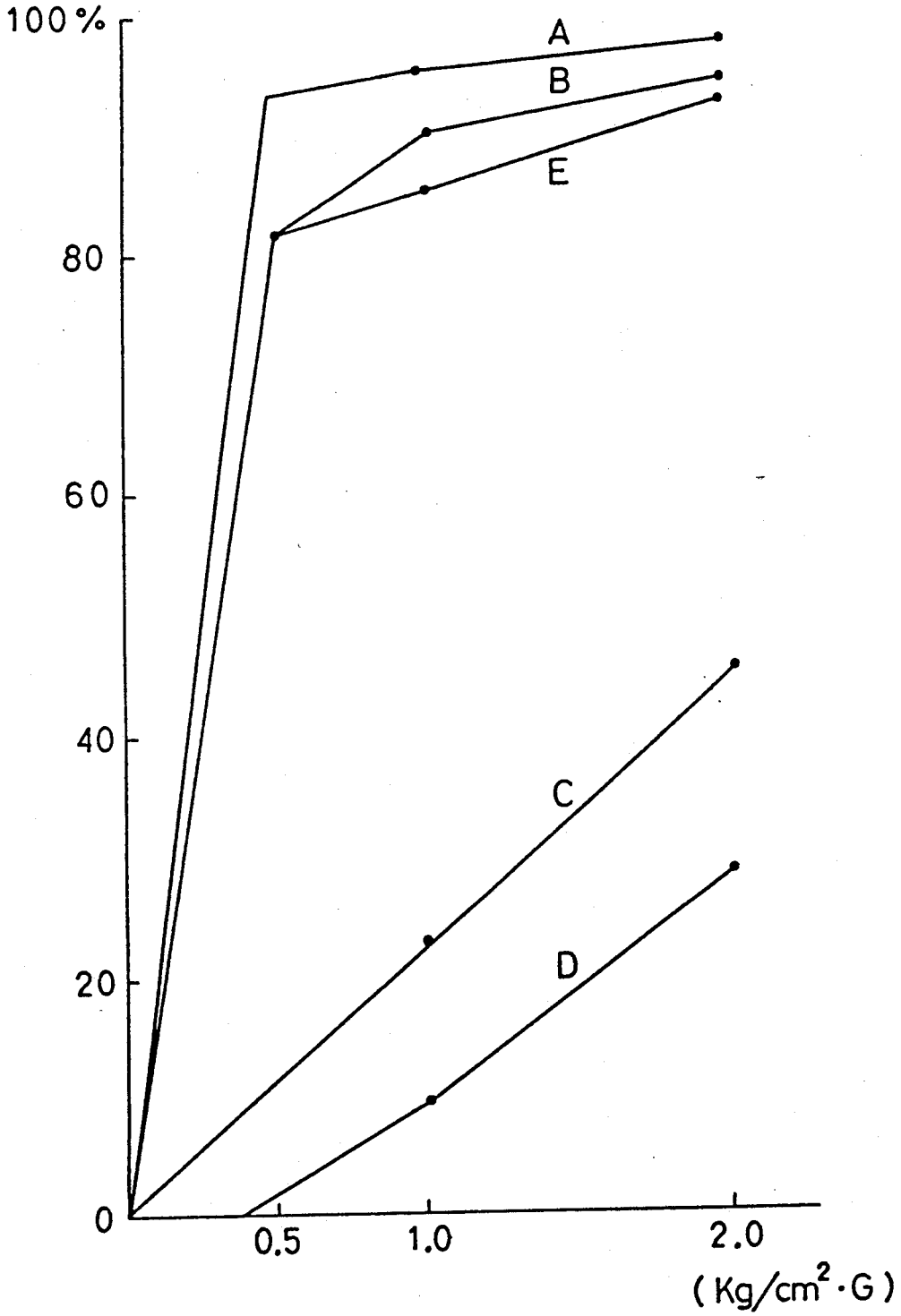
FIG. 17 is a chart illustrating the relationship between the percentage of drainage of porous ceramics having various mean pore diameters and the pneumatic pressure.
Figure 18:
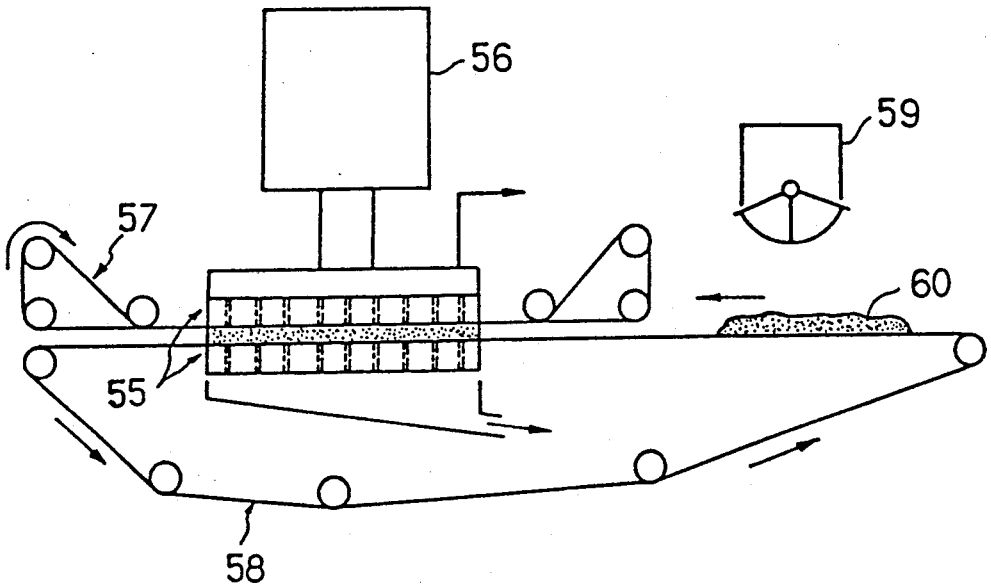
Fig.18 (PRIOR ART)
FIGS. 18 and 19 are views respectively illustrating examples of conventional dewatering apparatuses.
Figure 19:
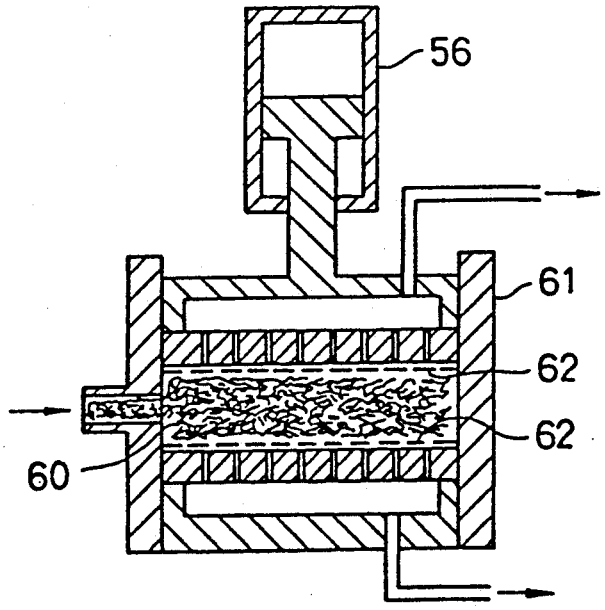
Fig.19 (PRIOR ART)

FIG. 17 is a chart showing the relationship between the percentage of drainage and the pneumatic pressure in the case where water retained in each of the porous ceramic plates having various mean pore diameters (shown in FIG. 15) was drained by applying pneumatic pressure for 2 to 4 seconds. As will be clear from FIG. 17, the larger the mean pore diameter, the higher the percentage of drainage, and C and D which have mean pore diameters of about 30 μm or less involve unfavorably low percentages of drainage. However, E has a good percentage of drainage despite the fact mean pore diameter in the surface is relatively small.

The above-described results show that the porous ceramic plates A, B and E respectively having mean pore diameters 260 μm, 140 μm and 140 μm (parent body)+4 μm are able to instantaneously drain water at 80% or more with a pneumatic pressure of about 0.5 $kg/cm^2G$.

Theoretical consideration about the drainage of water can also be explained in terms of the capillary phenomenon.

If it is assumed that:

| | |
|---|---|
| difference in terms of height between liquid levels inside and outside a capillary tube: | h |
| radius of the capillary tube: | r |
| density of a liquid: | ρ |
| surface tension of the liquid: | T |
| contact angle: | Θ |
| acceleration of gravity: | g |

then, $$hpg = 2T \cos \theta / r$$

$$h = 2T \cos \theta / rpg$$

In the case of water, T=72.6 dyn/cm and $\theta = 8°$. Therefore, from the above-described equation, h is as follows:

$$h = (2 \times 72.6 \times 10^{-5}\ N/cm \times \cos 8°)/(r\ cm \times 10^{-3}\ kg/cm^3 \times 9.8\ N/kg)$$
$$= 0.147/r\ cm$$

Accordingly, when the pore diameter 2r=100 μm=0.01 cm, $$h = 29cm \approx 0.03 kg/cm^2.$$

whereas, when the pore diameter 2r=10 μm=0.001 cm, $$h = 290cm \approx 0.3 kg/cm^2$$

Thus, it will be understood that substantially no water can be drained from the porous ceramic plate D having a mean pore diameter of 8 μm with a pneumatic pressure of 0.3 $kg/cm^2$.

Further, the separability of sludge or the like adhering to a press surface formed from a rigid porous material involves the following facts.

(1) As the mean pore diameter increases, the water absorption performance becomes better, and the capacity of retaining sludge or the like is higher. Therefore, even when sludge or the like is pressed, substantially no sludge flows out from the gap between a pair of press surfaces. However, a mean pore diameter exceeding 20 μm may involve difficulties in effecting separation according to the kind of sludge or the like.

(2) It is a matter of common sense that, as the mean pore diameter decreases, the separability of sludge or the like becomes better. However, if regeneration (draining of water) by means of pneumatic pressure is carried out every time, the mean pore diameter is allowed to be somewhat large.

(3) When the speed of water absorption, regeneration of capillary tubes, separability and outflow of sludge or the like are taken into consideration, the mean pore diameter is preferably from 0.5 to 350 μm, more preferably from about 1 to about 200 μm, although the range depends upon the kind of sludge or the like.

However, when the rigid porous material consists of one layer, the mean pore diameter is preferably set at from about 30 to about 200 μm, whereas, when it consists of two layers having a surface thin film, the mean pore diameter in the film portion is preferably set at from 1 to 30 μm.

(4) The separability of sludge or the like depends on the configuration of particles constituting the rigid porous material employed. Rigid porous material is generally constituted by, for example, a granular, acicular, plate-shaped or fibrous particles or a mixture thereof. Among these materials, a porous material constituted by plate-shaped particles allows sludge to be readily separated by virtue of the flat surfaces of the plate-shaped particles. Further, the mean aspect ratio of plate-shaped particles (the length in the major axis direction/-the length in the minor axis direction of plate-shaped particles) is preferably from 2 to 50.

(5) In press-dewatering effected by a pair of rigid porous materials, if the two materials have different mean pore diameters, when these materials are separated from each other, sludge adheres to the one which has a larger mean pore diameter. Further, the one of the two materials to which sludge is to adhere can be determined by the degree to which they are regenerated. It should be noted that, when press-dewatering by rigid porous materials is effected in a state wherein a sludgy substance is sandwiched between two filter cloth belts, it is unnecessary to be particularly scrupulous about the separability.

FIGS. 1 to 5 are views illustrating in combination a first embodiment of the present invention.

In FIGS. 1 to 5, the reference numerals 11 denote dewatering rolls which are disposed in parallel opposing relation to each other and which are rotatable in opposite directions to each other around respective shafts 41 that define rotating shafts. Each dewatering roll 11 has an outer casing 44 having a multiplicity of grooves 42 formed in the circumferential direction and a multiplicity of radial small bores 43 which extend through the casing 44 so as to be communicated with the grooves 42, and a rigid porous material 6 covering the outer periphery of the outer casing 44.

Rings 45 are rigidly secured to each shaft 41, and an inner casing 46 is mounted on rings 45, the rings 45 and casing 46 defining a hollow shaft, and the outer casing 44 is rigidly secured to the respective outer peripheral ends of ribs 47 which are radially disposed on the inner casing 46. The ribs 47 equally partition the area between the inner casing 46 and the outer casing 44 in the radial direction, and two ends of the outer casing 44 are closed by end plates 48 and 48', respectively. Each of the partitions surrounded by the ribs 47 and the end plates 48, 48' defines an air supply chamber 49. Further, a pressurized air inlet pipe 10 is engaged with one end plate 48, the pipe 10 being retained through a pressure plate 51 which is in sliding engagement with end plate 48 while covering air supply bores 50 for supplying pressurized air into the air supply chambers 49 partitioned by the ribs 47 and which is provided with a communicating bore, so that, as the dewatering rolls 11 rotate, pressurized air is successively supplied into the air supply chambers 49 partitioned by the ribs 47 from the respective air supply bores 50.

Figure 1:
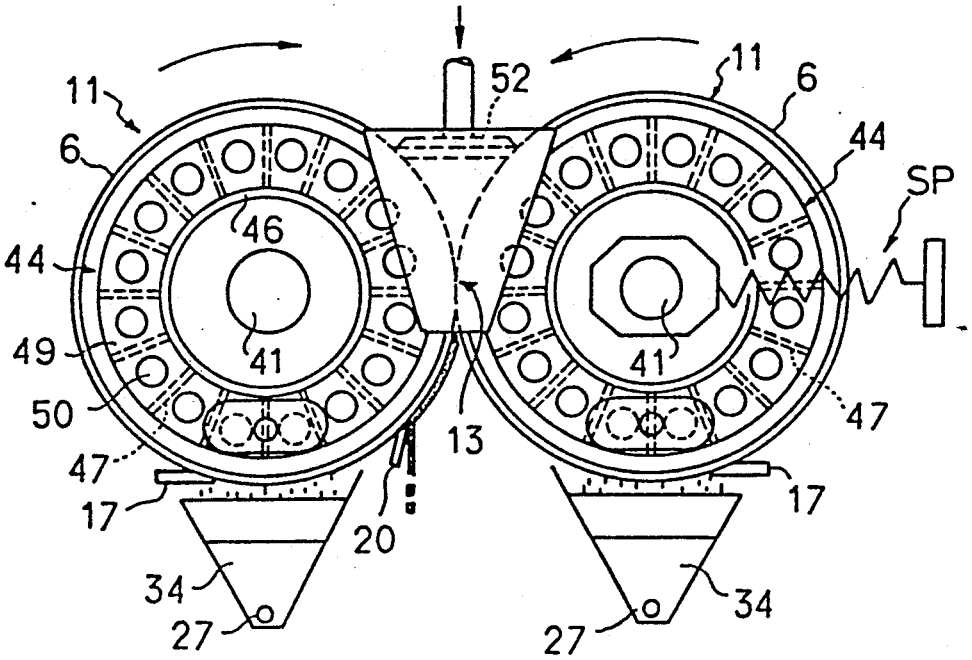
FIG. 1 is a side view illustrating a first embodiment of the present invention.
Figure 2:
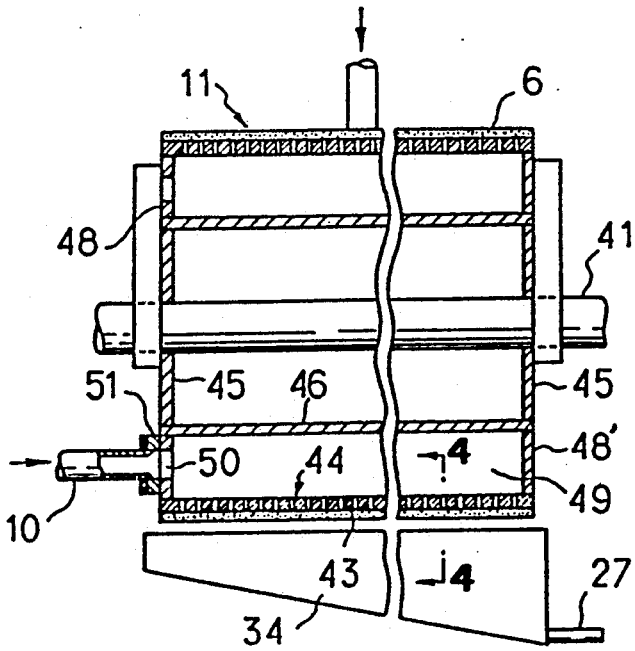
FIG. 2 is a sectional view illustrating air supply chambers shown in FIG. 1 which are in a connected state.
Figure 3:
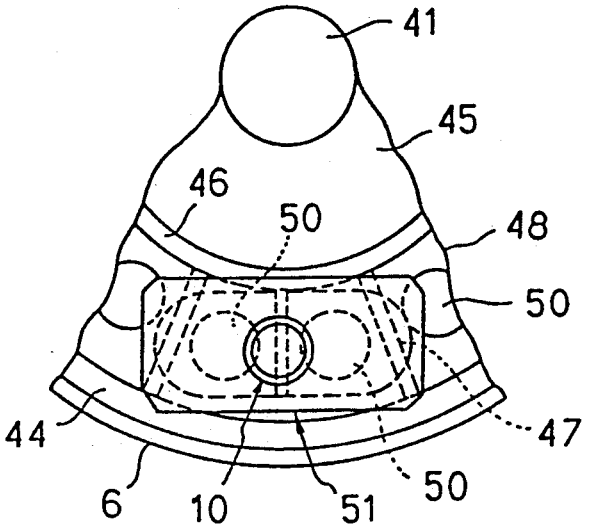
FIG. 3 is a view illustrating a part of the left-hand side of the arrangement shown in FIG. 2.

It should be noted that it is preferable to axially partition the space by the ribs 447 into four or more equal air supply chambers 49, the example shown in FIG. 1 having 6 equally divided chambers 49.

Further, a dewatered substance supply section 52 into which is forced a substance which is to be dewatered is provided above the nip portion 13 between the dewatering rolls 11, and a doctor blade 20 for separating dewatering cake is provided at the downstream side of the nip portion 13 in such a manner that the doctor blade 20 is in contact with the rigid porous material 6 provided on the surface of one dewatering roll 11. In the example shown in FIG. 1, since the rigid porous material 6 on the surface of the left-hand side dewatering roll 11 has a larger mean pore diameter than that of the rigid porous material 6 on the surface of the right-hand side dewatering roll 11, dewatering cake coming out of the nip portion 13 adheres to the surface of the rigid porous material 6 on the surface of the left-hand side dewatering roll 11, and therefore it suffices to dispose the doctor blade 20 only at the left-hand side dewatering roll 11. It should be noted that, when the surface roughness of the rigid porous material 6 on the left-hand side dewatering roll 11 is set so as to be greater than that of the rigid porous material 6 on the right-hand side dewatering roll 11, dewatering cake coming out of the nip portion 13 also adheres to the rigid porous material 6 on the surface of the left-hand side dewatering roll 11; therefore, in such case also, it suffices to dispose the doctor blade 20 only at the left-hand side dewatering roll 11.

Figure 4:
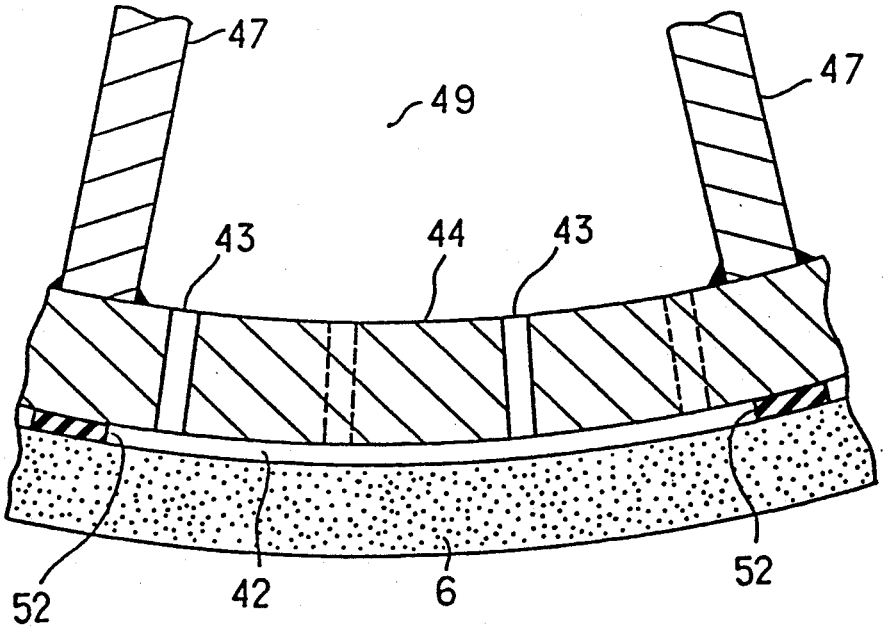
FIG. 4 is a fragmentary sectional view taken along the line 4—4 in FIG. 2.

Further, seal members 52 are disposed in the grooves 42 circumferentially formed in the outer casing 44 at positions where the ribs 47 partitioning the air supply chambers 49 are attached as shown in FIG. 4, thereby shutting off communication between portions of grooves 42 in the circumferential direction, so that capillary regeneration of each rigid porous material 6 is carried out only at the outer surface corresponding to each air supply chamber 49 supplied with pressurized air as described later.

Further, a doctor blade 17 for scraping off water adhering to the surface of each rigid porous material 6 is provided in a regeneration region which is subsequent to and at the downstream side of the cake separating doctor blade 20 and in which capillary tubes are regenerated by means of pressurized air, and the water scraped off by the doctor blade 17 is collected into a drain tank 34 which is disposed below the regeneration region and which is provided with a discharge pipe 27.

In the dewatering apparatus shown in FIG. 1, a substance to be dewatered, such as sludge, which is forced into the dewatered substance supply section 52 is pressed by the respective surfaces of the rigid porous materials 6 of the dewatering rolls 11 and 11, and a part of the water possessed therein is absorbed by the rigid porous materials 6. As the dewatering rolls 11 rotate, the substance to be dewatered comes to the nip portion 13, where water inside the substance is squeezed by pressing, and the squeezed water is rapidly absorbed into the rigid porous materials 6 by means of the capillary action of the materials 6 and retained thereby. After the dewatered substance has passed the nip portion 13 and consequently released from the pressing force, substantially no water returns into the dewatered substance from the rigid porous materials 6 by virtue of the water retention capacity of the materials 6, so that there is no fear of the dewatered cake becoming rewetted.

In the way described above, water in the sludge is retained by the capillary action of the rigid porous materials 6, and the dewatered cake after separating from the nip portion 13 adheres to the surface of the rigid porous material 6 on the left-hand side dewatering roll 11 having a larger mean pore diameter. The dewatering cake adhering to the rigid porous material 6 is scraped off by the doctor blade 20 and transported to the outside by a conveyor (not shown) or the like. As the dewatering rolls 11 further rotate, pressurized air is supplied into the air supply chambers 49 from the corresponding pressurized air inlet pies 10 via the air supply bores 50 and through the pressure plates 51 which are in sliding engagement with the surfaces of the side plates 48, so that the pressurized air is jetted out into each rigid porous material 6 from the side thereof which is opposite to the water absorption side through the small bores 43 and grooves 42 in the outer casing 44, thereby discharging the water absorbed in the rigid porous material 6 into the associated drain tank 34 and thus allowing the capillary tubes in the material 6 to be regenerated.

Further, among the water discharged from each rigid porous material 6, the water adhering to the surface thereof is scraped off by the associated doctor blade 17 and collected in the drain tank 34. Since scraping off water by each doctor blade 17 is carried out in the capillary regeneration region where pressurized air is jetted out, there is no fear of water scraped off by the doctor blade 17 being absorbed by the capillary tubes of the rigid porous material 6, which would otherwise hinder the regeneration of the capillary tubes. The water collected in each drain tank 34 is discharged through the associated discharge pipe 27. As the dewatering rolls 11 further rotate, portions of the rolls 11 which have first been used to perform press-dewatering accompanied by the capillary action take part in press-dewatering again, and in this way the press-dewatering step accompanied by the capillary action, the dewatered cake separating step, the capillary regeneration step and the drainage step are repeated by the rotation of the dewatering rolls 11, thus allowing continuous dewatering of a substance which is to be dewatered, such as sludge.

Figure 5:
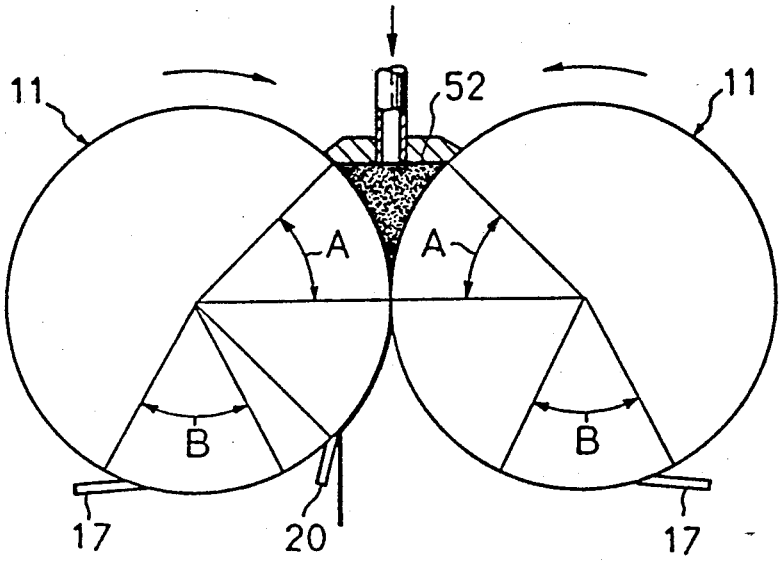
FIG. 5 is a view employed to describe operation steps of the embodiment shown in FIG. 1.

The press-dewatering step, the dewatering cake separating step and the capillary regeneration (jetting out of pressurized air) step in the above-described dewatering apparatus are shown in FIG. 5. More specifically, dewatering is carried out in the regions A shown in the figure, and separation of pressed dewatered cake is subsequently effected by the doctor blade 20, and then regeneration of capillary tubes is carried out in the regions B.

If the above-described dewatering apparatus employs a rigid porous material 6 which is constituted by two layers having different mean pore diameters (from 0.5 to 350 μm) or a continuous multilayer integral material and the layer having a smaller mean pore diameter is used to define the outer side which comes into contact with a substance to be dewatered such as sludge, even when the surface of the rigid porous material 6 is clogged, there is no fear of the inner side of the material 6 being clogged, and it becomes easier to regenerate the rigid porous material 6 by supplying pressurized air from the side thereof which is opposite to the water absorption side.

It should be noted that a multiplicity of layers which constitute the rigid porous material 6 need not be made of the same material and it is possible to employ a combination such as a ceramic and a metal, a ceramic and a plastic, or a plastic and a metal.

Further, a rigid porous material may be provided on the surface of either one of the dewatering rolls 11, and it is also possible to provide rigid porous materials on the surfaces of both the dewatering rolls 11, or define either one of the dewatering rolls 11 by a roll having its surface formed from a flexible substance, for example, a rubber roll having either water impermeability or water permeability, a pneumatic roll or a sponge roll.

The multilayer integral material for the rigid porous material 6 includes a multilayer arrangement in which the pore diameter increases continuously or stepwisely from the surface layer toward the center.

The rigid porous material 6 is bonded to the surface of the outer casing 44 by means of an adhesive or the like, and it is therefore preferable to divide a rigid porous plate having a thickness of about 10 to 15 mm into split plates about 10 to 30 cm square and bond these plates to the outer surface of the outer casing 44 when taking into consideration manufacture of the rigid porous material 6 and replacement thereof at the time of breakage.

The split rigid porous plates 6 are preferably bonded in such a manner that the sides of the split plates 6 are coincident with the circumferential direction of the dewatering roll 11 and the plates 6 are staggered from each other by about 5 to 15 cm in the axial direction of the roll 11 and further the sides thereof are in close contact with each other.

Figure 6:
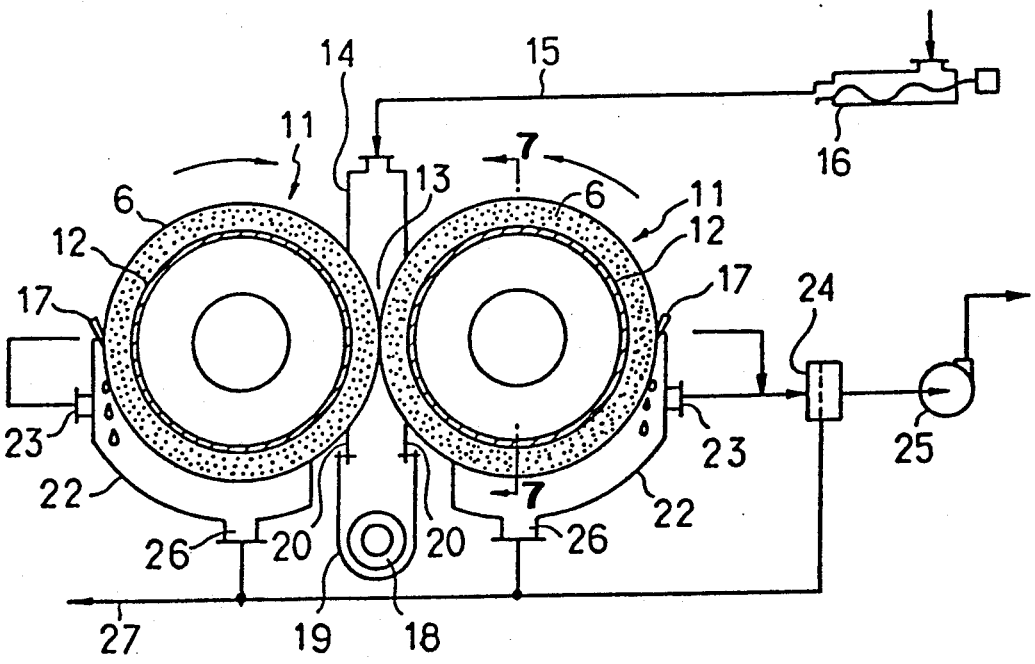
FIG. 6 is a sectional side view illustrating a second embodiment of the present invention.
Figure 7:
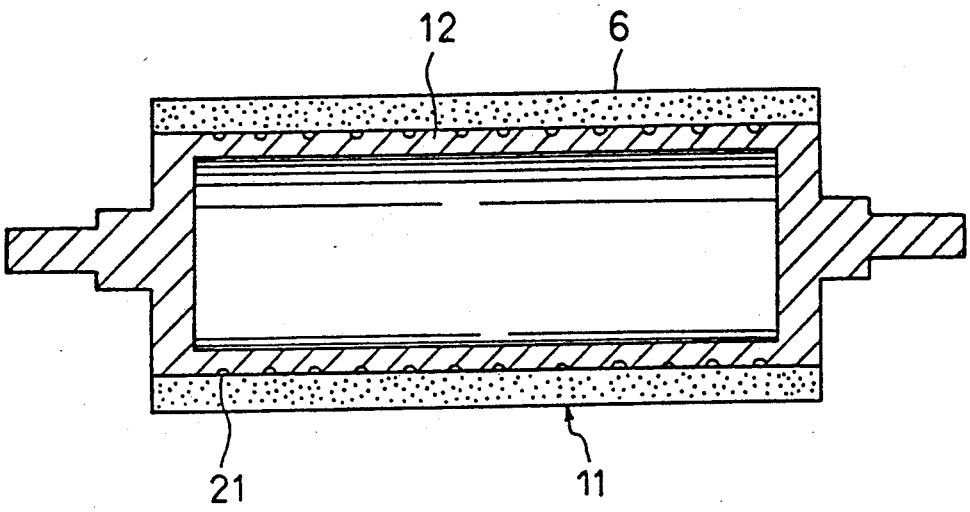
FIG. 7 is a sectional view taken along the line 7—7 in FIG. 6.

FIGS. 6 and 7 are views illustrating a second embodiment of the present invention.

In the figures, each of the dewatering rolls 11 is formed by rigidly securing (in general, bonding by means of an adhesive) a rigid porous material 6 to the other peripheral surface of a cylinder 12 which has a hollow cylindrical configuration and has no bores formed in its outer peripheral surface, the dewatering rolls 11 being disposed in opposing relation to each other and extending axially parallel to each other in such a manner that they are rotatable in opposite directions to each other.

A supply tank 14 is disposed at the side of the dewatering rolls 11 where the respective surfaces of the rolls 11 approach each other when they are rotated in operation, the supply tank 14 being pressed against the surfaces of the dewatering rolls 11 and 11 so that the tank 14 is sealed. The supply tank 14 has the same axial length as the dewatering rolls 11, and two axial end faces of the tank 14 are also sealed by seal plates (not shown). Thus, when a substance which is to be dewatered is forced into the supply tank 14 through a raw material supply pipe 15 provided above it by the action of a screw pump 16 or a screw feeder, the substance can hold a pressure in such a manner that the substance disperses and fills the inside of the supply tank 14. This pressure is about from 0.1 to about 5 kg/cm$^2$ although it depends on the kind of the substance to be dewatered.

In the dewatering apparatus having the above-described arrangement, when the dewatering rolls 11 press a substance to be dewatered at the nip portion 13, water which is pressed out is absorbed into and retained by the rigid porous materials 6 by means of the capillary action. Since the retention of water by the capillary action of the rigid porous materials 6, that is, the water retention action, works so that substantially no water returns from the rigid porous materials 6 into the dewatered cake after it has passed the nip portion 13 and is consequently released from the pressing force, it is possible to reduce the amount of water which may be absorbed by the dewatered cake again. The dewatered cake having passed the nip portion 13 is separated by doctor blades 20 which are provided at the side of the dewatering rolls 11 where their respective outer peripheries are separated from each other by the rotation of the rolls 11, that is, below the rolls 11, in such a manner that the doctor blades 20 are in pressure contact with the dewatering rolls 11 in the axial direction thereof. A screw conveyor 18 for transporting the dewatered cake to the outside is disposed below the doctor blades 20. Further, a hood 22 is mounted subsequently to and at the downstream side of each doctor blade 20 in the direction of rotation of the corresponding dewatering roll 11.

Each hood 22 tightly covers the outer periphery of the corresponding dewatering roll 11, and a doctor blade 17 which is in contact with the outer periphery of the dewatering roll 11 is disposed at the edge of the hood 22 on the side thereof which is remote from the doctor blade 20. Further, a suction port 23 and a drain port 26 are provided in the side and lower portions, respectively, of each hood 22. A demister 24 to which a blower 25 is connected is connected to both the suction ports 23, and the separated water discharge side of the demister 24 and both the drain ports 26 are connected together by a discharge pipe 27.

When the dewatering rolls 11 disposed in the respective hoods 22 rotate, suction is exerted on the suction ports 23 by the blower 25 through the demister 24 to reduce the pressure inside the hoods 22 in order to introduce water collected in the hoods 22 into the drain ports 26 and discharge water separated by the demister 24 through the discharge pipe 27, thereby producing a vacuum on the surface side of each rigid porous material 6 and thus enabling water contained in the material 6 to be taken out effectively. Each doctor blade 17 scrapes off water attached to the surface of the corresponding rigid porous material 6 before it comes out of the hood 22, and drops the scraped water into the hood 22.

In this embodiment, as shown in FIG. 7, a multiplicity of small grooves 21 are provided in the outer periphery of each cylinder 12 in such a manner that the grooves 21 extend circumferentially and completely surround the circumference of the cylinder 12 in order to facilitate the discharge of water absorbed by the rigid porous material 6. Provision of a multiplicity of such small grooves 21 allows water absorbed in the rigid porous material 6 to be readily discharged, since water absorbed in the lower half of each dewatering roll 11 at the downstream side of a position near the nip portion 13 can be replaced by air which enters the material 6 through the small grooves 21 while said half of the roll 11 passes through the area above the center thereof.

Further, in this embodiment, a substance to be dewatered such as sludge is pumped into the supply tank 14 from the raw material supply pipe 15 and pressed against the surfaces of the rigid porous materials 6 provided on the dewatering rolls 11, and a part of water possessed by the substance is thereby absorbed into the materials 6. As the dewatering rolls 11 rotate, the substance to be dewatered reaches the nip portion 13, where water in the substance is squeezed by pressing and, at the same time, the squeezed water is rapidly absorbed by virtue of the capillary action of the rigid porous materials 6, and dewatered cake is scraped off by the doctor blades 20, dropped into the casing 19 and transported to the outside by the screw conveyor 18. As the dewatering rolls 11 further rotate to reach the hoods 22, since the inside of the hoods 22 have already been reduced in pressure by the suction effected by the blower 25, the water absorbed and retained in the rigid porous materials 6 is sucked out of them, and water adhering to the surfaces of the materials 6 is scraped off by the doctor blades 17. Water collected in the hoods 22 is discharged through the discharge pipe 27.

Thus, a vacuum is applied to respective outer peripheries of the dewatering rolls 11 having passed the nip portion 13 at the downstream side of the nip portion 13, thereby drawing out water absorbed and retained in the rigid porous materials 6 provided on the dewatering rolls 11 and effecting regeneration whereby the number of voids in the dewatering rolls 11 are increased to enhance the capacity of the rigid porous materials 6 to absorb water at the nip portion 13 in the next dewatering operation.

Figure 8:
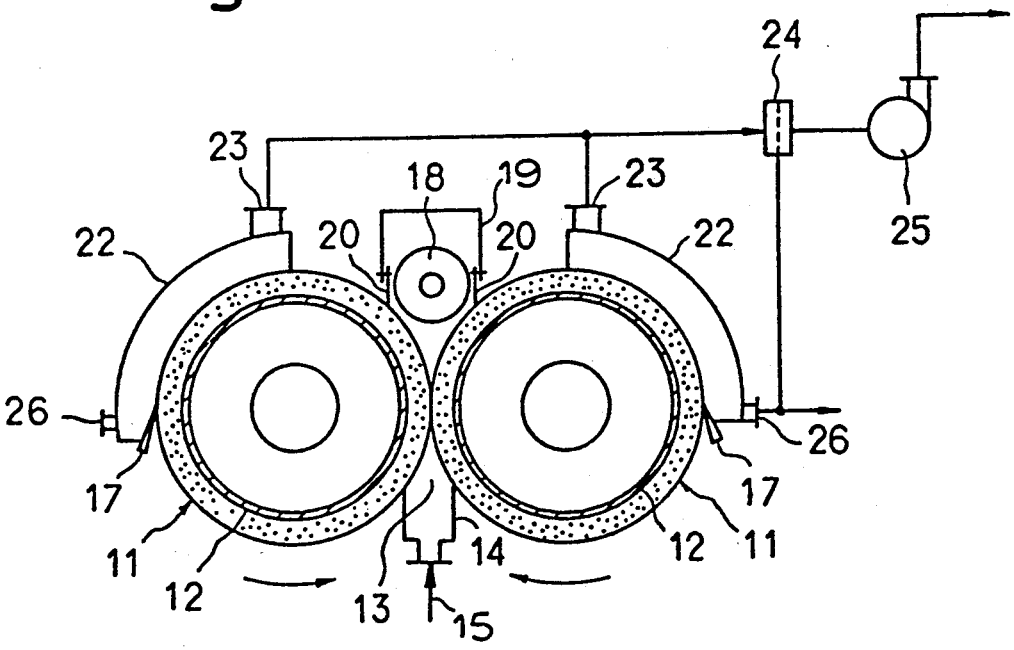
FIG. 8 is a sectional side view illustrating a third embodiment of the present invention.

FIG. 8 illustrates a third embodiment of the present invention. In this embodiment, the dewatering apparatus shown in FIG. 6 is arranged upside down. The arrangement of this embodiment is substantially the same as that of the embodiment shown in FIG. 6 except that in this embodiment a screw conveyor 18 is disposed as close to the outer peripheries of the dewatering rolls 11 as possible.

Figure 9:
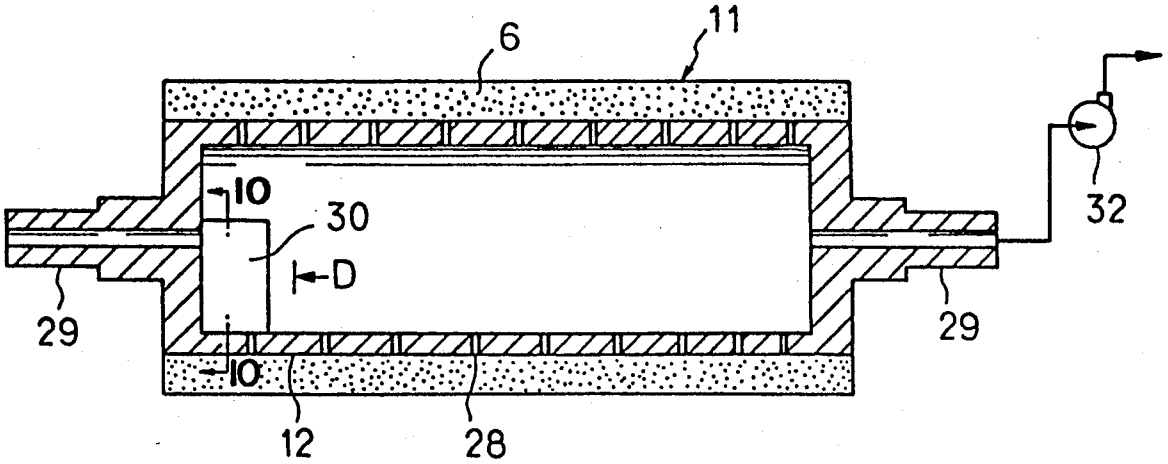
FIG. 9 is a longitudinal sectional view of a dewatering roll in accordance with a fourth embodiment of the present invention.
Figure 11:
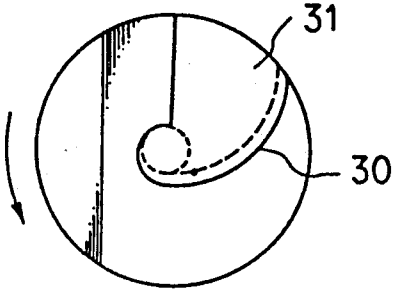
FIG. 11 is a view taken in the direction of the arrow D in FIG. 9.

FIGS. 9 and 11 are views illustrating in combination a fourth embodiment of the present invention. As illustrated, in this embodiment, a multiplicity of small bores 28 are formed in the whole surface of the cylinder 12 provided with the rigid porous material 6, the small bores 28 radially extending through the cylinder 12. One end plate 31 of the cylinder 12 is provided with a liquid scooping blade 30 positioned in such a manner that a central bore in a hollow shaft portion 29 is contained inside the blade 30, and is the end edge of the liquid scooping blade 30 is against the end plate 31 in such a manner that the blade 30 defines a container. The liquid scooping blade 30 may be provided so as to extend over the entire length of the cylinder 12.

A drainage device (not shown) is provided at the end of the hollow shaft portion 29 whose central bore is communicated with the inside of the liquid scooping blade 30, the drainage device being communicated with the central bore by means of a rotary joint, although the details thereof are not shown. The central bore of the other hollow shaft portion 29 is communicated with a suction port of a blower 32.

The small through-bores 28 may be provided in the bottoms of small streak-like grooves (not shown) circumferentially provided in the outer peripheries of suction ports of the cylinder 12 or in the bottoms of axially extending small streak-like grooves (not shown) which do not extend through the cylinder 12 but terminate at positions just before both ends of the cylinder 12.

In FIG. 9, since water absorbed and retained in the rigid porous material 6 provided on the dewatering roll Il is sucked in by a vacuum produced inside the roll 11, it is appropriate to constitute the rigid porous material 6 by a double-layer integral material having different mean pore diameters ranging from 0.5 to 350 μm and arrange the material such that a surface thereof having a smaller mean pore diameter defines the outer side which comes into contact with a substance to be dewatered, or constitute the rigid porous material 6 by a multilayer material whose outer surface is defined by a surface having a smaller mean pore diameter and which is gradually increased in terms of pore diameter to the other surface thereof.

Figure 10:
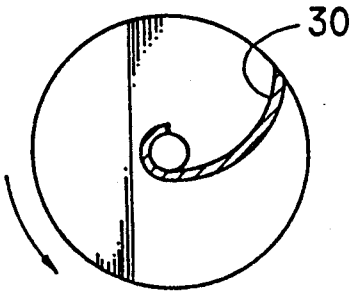
FIG. 10 is a sectional view taken along the line 10—10 in FIG. 9.

In FIG. 9, when the dewatering roll 11 is rotating, the blower 32 sucks in the air in the cylinder 12, and the inside of the cylinder 12 is therefore placed under a vacuum, so that water which is absorbed and retained in the rigid porous material 6 is sucked into the inside of the cylinder 12 through the small through-bores 28 and collected in the bottom of the cylinder 12. When the cylinder 12 rotates in the direction of the arrows shown in FIGS. 10 and 11, the water in the bottom of the cylinder 12 is scooped up by the liquid scooping blade 30 from the outer peripheral side thereof, and when the blade 30 is rotated toward this side as viewed in FIG. 9, the blade 30 sends the scooped liquid into the central bore in the hollow shaft portion 29, thus discharging it.

In the embodiment shown in FIG. 9, since the pressed out water is led to the inside of the dewatering roll 11, it is easy to seal a passage of the pressed out water, a pan (hood) for receiving the pressed out water, etc., and the number of portions parts which are necessary to seal is relatively small, which means that it is possible to effect drainage completely and cleanly.

Figure 12:
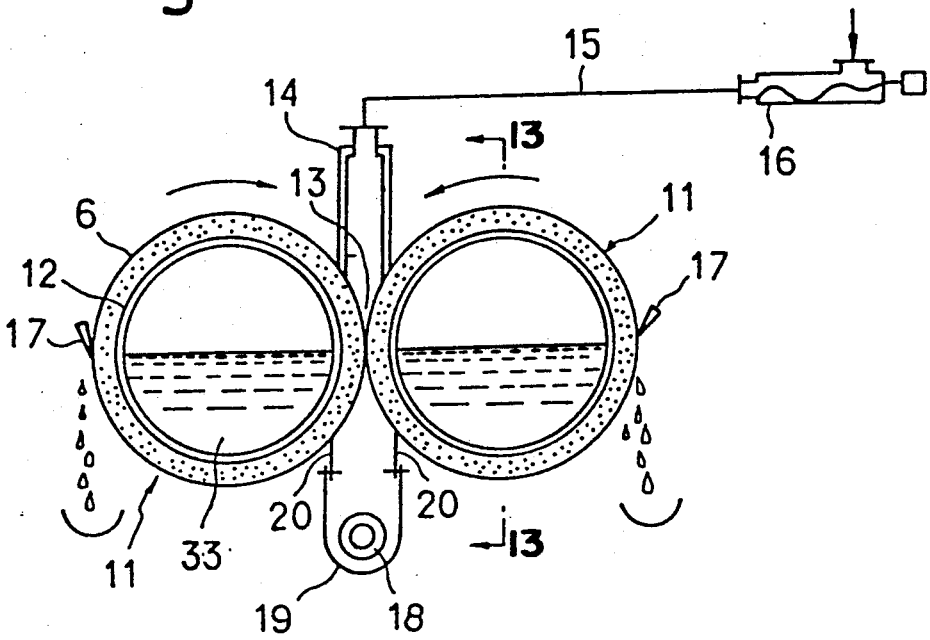
FIG. 12 is a sectional side view of a fifth embodiment of the present invention.
Figure 13:
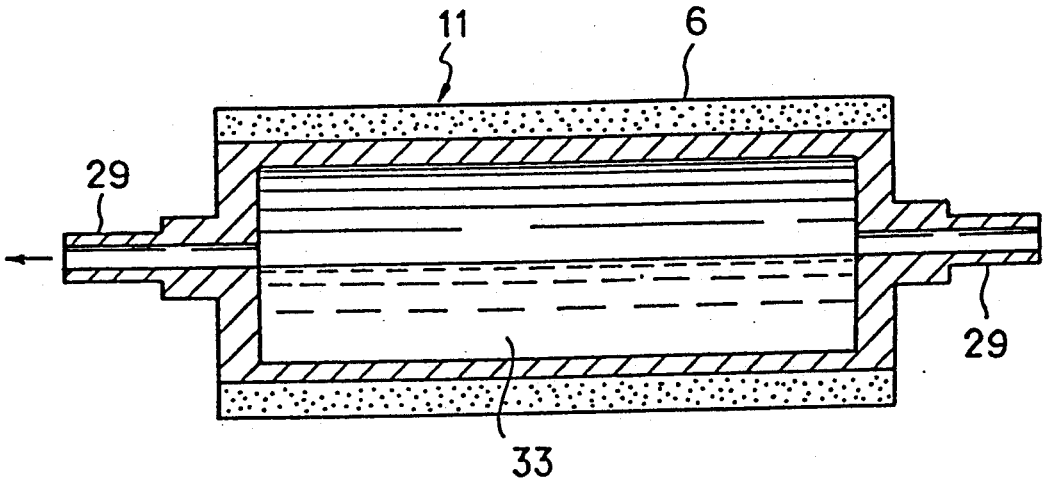
FIG. 13 is a sectional view taken along the line 13—13 in FIG. 12.

FIGS. 12 and 13 are views illustrating in combination a fifth embodiment of the present invention. Hot water or a heating medium 33 is supplied through the central bore in one of the hollow shaft portions 29 of two end plates of the cylinder 12 and discharged through the central bore in the other hollow shaft portion 29, and the hot water or heating medium 33 is then heated by heating means (not shown) and recirculated to the central bore in the first hollow shaft portion 29. The liquid level of the hot water or heating medium 33 in the dewatering roll 11 is set below the vicinity of the axial center of the roll 11, so that the hot water or heating medium 33 heats the dewatering roll 11 at the downstream side of the roll 11 which has passed the nip portion 13. During operation, the dewatering rolls 11 are driven so as to rotate in opposite directions to each other as shown by the arrows in the figure, so that the outer peripheries of the dewatering rolls 11 move downwards at the nip portion 13.

A substance to be dewatered such as sludge which is pumped from the raw material supply pipe 15 enters the sludge supply tank 14 and is then pressed by the respective surfaces of the rigid porous materials 6 of the dewatering rolls 11, and a part of water possessed by the substance is absorbed by and attached to the rigid porous materials 6 by the capillary action. As the dewatering rolls 11 rotate, the substance to be dewatered reaches the nip portion 13, where water possessed by the substance is removed therefrom by pressing, and the squeezed water is rapidly absorbed by the capillary action of the rigid porous materials 6.

The water absorbed by the rigid porous materials 6 is caused to overflow rapidly from the surfaces of the rigid porous materials 6 by the heating effected by the hot water or heating medium 33 from the inside of the dewatering rolls 11. Accordingly, the rigid porous materials 6 employed in this embodiment are preferably formed from a good heat conductor. As a result, when the rigid porous material which has passed the nip portion 13 and has water absorbed therein is heated, the water absorbed and retained in the rigid porous materials 6 is pushed out by the expansion of air or the vapor pressure of liquid which is present closer to portions of the cylinders 12 at the heated sides thereof, and then scraped off by the doctor blades 17, thus regenerating the capillary tubes of the rigid porous materials 6. As described above, the water absorption and retention by the capillary action and the regeneration of the capillary tubes are continuously repeated every revolution of each dewatering roll 11.

The means for regenerating the capillary action may be microwave heating in place of the above-described method (shown in FIGS. 12 and 13) wherein the hot water or heating medium 33 is passed through each dewatering roll 11. Microwave heating enables the inside of the roll 11 to be heated from the outside.

Figure 14:
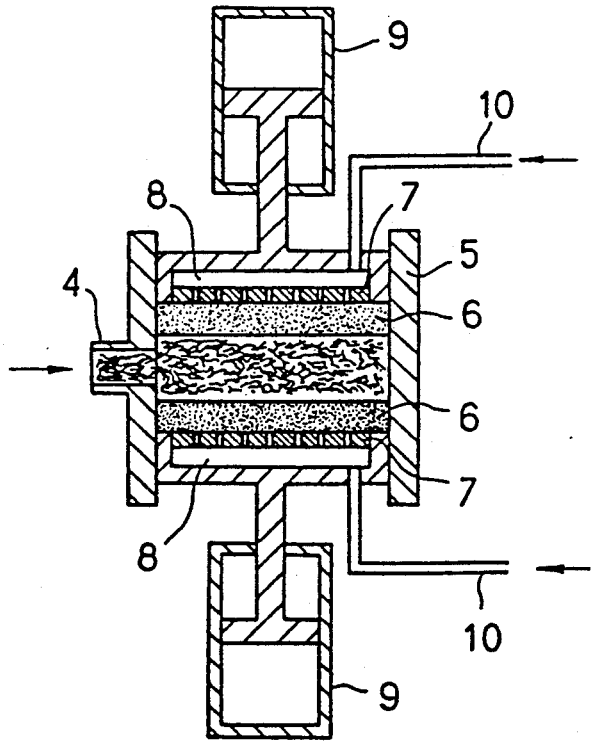
FIG. 14 is a sectional view illustrating a sixth embodiment of the present invention.

FIG. 14 is a view illustrating a sixth embodiment of the present invention. As illustrated in the figure, the dewatering apparatus has a structure wherein rigid porous materials 6 are disposed so as to face each other vertically within a tank 5 provided with a dewatered substance supply port 4 for supplying a substance to be dewatered such as sludge, the port 4 being disposed at a position intermediate between the materials 6. The respective sides of the upper and lower rigid porous materials 6 and 6 which are opposite to the opposing pressing and water absorbing surfaces are rigidly secured to respective presses 9 each having a rigid porous material supporting and ventilating plate 7 formed with a multiplicity of vent holes and further having an air chamber 8, and pressurized air inlet pipes 10 and 10 are opened into the upper and lower air chambers 8, respectively.

In the dewatering apparatus having the above-described structure, a substance to be dewatered is forced into the area between the upper and lower rigid porous materials 6 within the tank 5 and then pressed by the presses 9, whereby, when the substance to be dewatered is sludge, water pressed out from between particles of the sludge is absorbed into the rigid porous materials 6 by the capillary action of the materials 6 and the water pressure, thus dewatering the sludge.

After press-dewatering has been effected in this way, for example, the lower press 9 is removed from the tank 5, and dewatered cake remaining on the press 9 is discharged by a pusher (not shown) or other means. Then, pressurized air is supplied to the air chambers 8 by a compressor or the like (not shown), passed through the multiplicity of vent holes in the rigid porous material supporting and ventilating plates 7 and jetted out from the sides of the rigid porous materials 6 which are opposite to the pressing and water absorbing sides, thereby discharging the water absorbed by the rigid porous materials 6 by the capillary action and thus regenerating the capillary tubes. In this case, when the mean pore diameters of the upper and lower rigid porous materials 6 are made different from each other, for example, when the mean pore diameter of the lower rigid porous material is made larger, dewatered cake remains on the upper surface of the lower rigid porous material 6. It should be noted that it may be unnecessary to provide both upper and lower rigid porous materials 6 and it may suffice only to provide the materials 6 on one of the plates 7 accordance with the quality and amount of the substance to be dewatered. In addition, when the surface roughnesses of the rigid porous materials 6 are made different from each other, for example, when the surface roughness of the lower rigid porous material 6 is made greater than that of the upper rigid porous material 6, dewatered cake also adheres to the upper surface of the lower rigid porous material 6.

Further, when porous ceramic plates ($\beta$-SiC) having various mean pore diameters which are shown in FIG. 15 were employed to press-dewater sludge having a water content of about 80% so as to be formed into dewatered cake having a water content of 50%, it was difficult to separate the dewatered cake from A having the largest mean pore diameter, but B opposing A had no cake adhering thereto. In the press-dewatering by a combination of B and C, although the dewatered cake remains on B having a larger mean pore diameter, the cake is readily separated therefrom and in the press-dewatering by a combination of, E and F also, it is extremely easy to separate the dewatered cake.

It should be noted that, in each of the above-described embodiments employing the dewatering rolls 11, both the dewatering rolls 11 may be fixed so that the distance between the respective axes is constant and the gap at the nip portion 13 between the rolls 11 is consequently constant, but it is also possible, depending on the kind of the substance to be dewatered, to arrange the apparatus such that one dewatering roll 11 is made movable in order to allow the gap at the nip portion 13 to be variable and a predetermined pressing force is applied to the substance to be dewatered by means of a spring SP (see FIG. 1) or hydraulic pressure. The gap at the nip portion 13 ranges from 0 mm to about 10 mm, but in operation the gap is generally from about 1 mm to about 4 mm.

Figure 20:
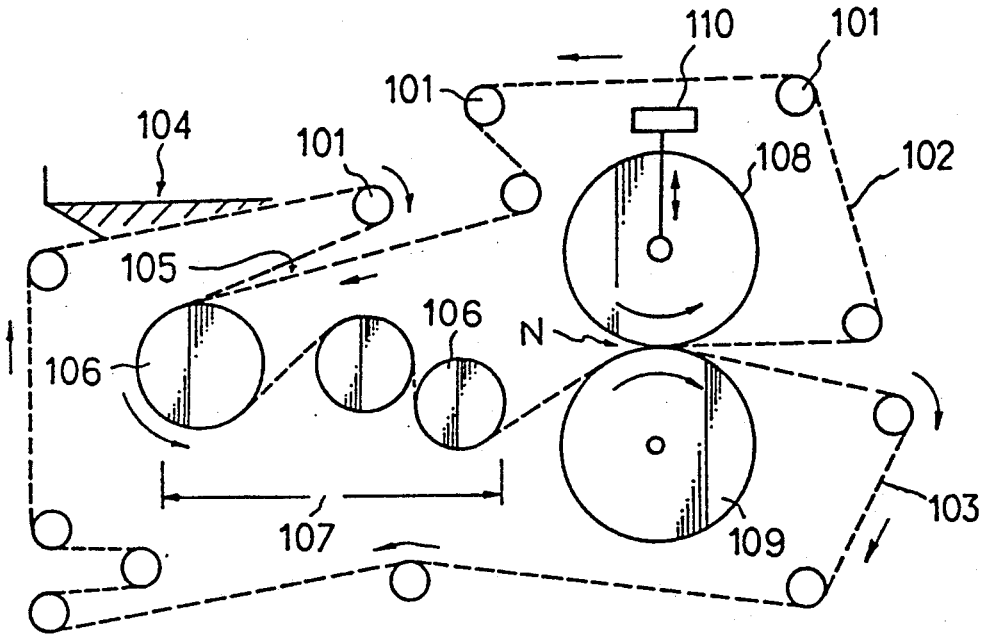
FIG. 20 is a view illustrating a seventh embodiment of the present invention.

FIG. 20 is a view illustrating a belt press type dehydrator in accordance with a seventh embodiment of the present invention.

The belt press type dehydrator has, as illustrated in the figure, two endless filter cloth belts 102 and 103 which are wrapped around a group of rolls 101 and disposed so as to travel in such a manner that respective predetermined portions of their opposing surfaces are laid one upon the other. A gravity dewatering section 104 for supplying a sludgy substance to be dewatered is disposed at a part of either the filter cloth belt 102 or 103, for example, the filter cloth belt 103. In addition, a wedge-shaped preliminary dewatering section 105 is defined between the filter cloth belts 102 and 103 along the direction of travel thereof, and a primary press section 107 is defined by one or a plurality of rolls 106 over which the filter cloth belts 102 and 103 pass while lying one upon the other.

Further, press rolls 108 and 109 sandwiching the filter cloth belts 102 and 103 are disposed next to the primary press section 107. One of the press rolls 108 and 109, that is, the press roll 108 is pressed against the other press roll 109 by a pressure generating mechanism 110. After passing through the area between the press rolls 108 and 109, and filter cloth belts 102 and 103 are separated from each other. At least one of the press rolls 108 and 109 (for example, the press roll 108) is defined by a hollow cylindrical dewatering roll having a rigid porous material bonded to the surface thereof, the material having water absorption capacity based on the capillary action.

In addition, the press roll 108, which is defined as the dewatering roll, may be provided with a capillary regenerating device. As the capillary regenerating device, it is preferable to employ a pressure type device arranged such that pressurized air is introduced into the hollow portion of the press roll 108 and jetted out into the rigid porous material when the surfaces of the press rolls 108 and 109 have passed the nip portion N, thereby removing water retained in the capillary tubes. In addition to the pressure type device, it is also possible to adopt, for example, a method wherein the hollow portion of the press roll 108 is sucked to produce a vacuum therein in order to remove water within the rigid porous material by means of suction, or a heating method wherein a heating medium is introduced into the hollow portion of the press roll 108 and water in the rigid porous material is pushed out by means of expansion of air or the vapor pressure of liquid caused by the heating.

In the belt press type dehydrator shown in FIG. 20, a sludgy substance to be dewatered is supplied to the gravity dewatering section 104 on the filter cloth belt 103 and transported while being subjected to gravity dewatering to reach the wedge-shaped preliminary dewatering section 105. In the preliminary dewatering section 105, the filter cloth belts 102 and 103 are laid one upon the other while sandwiching the substance to be dewatered to transport the substance to the primary press section 107, where it is subjected to primary pressing. Further, the substance to be dewatered is pressed between the press rolls 108 and 109 as the filter cloth belts 102 and 103 travel, thereby squeezing water remaining in the substance. The squeezed water is rapidly absorbed into the rigid porous material on the surface of the press roll 108 by the capillary action through the filter cloth belt 102, and the substance is then discharged in the form of dewatering cake having a low water content. When dewatering cake was formed from sewage sludge, it was possible to obtain dewatering cake having a cake thickness of from 3 to 10 mm and a water content of 60% or less at a travel speed of from 0.5 to 4 m/min. of the filter cloth belts 102 and 103. The adhesion of the rigid porous materials to a sludgy substance to be dewatered or dewatering cake depends on the pore diameter in the surface layer thereof, and if a rigid porous material having a pore diameter of 200 μm or less is employed for the surface, any sludgy substance or dewatering cake coming into direct contact with the surface is retained by the filter cloth side. Accordingly, it is possible to omit the filter cloth belt 102 on the side of the press roll 108 defined by the dewatering roll (see FIG. 21).

When dehydration utilizing the capillary action by means of a rigid porous material is directly employed to dewater a sludgy substance having a low concentration (a solid content of several %), the amount of water required to be absorbed increases, which means that it is ineffectively necessary to carry out absorption dewatering by means of a rigid porous material in a plurality of stages. Accordingly, it is preferable to employ the above-described press dehydration utilizing the capillary action of a rigid porous material as so-called secondary dewatering, i.e., dewatering of a sludgy substance which has been dewatered in advance by existing various dewatering processes until the water content becomes from about 80 to about 90%.

In general, an existing dewatering method by means of vacuum dehydration, belt press or the like is selected in accordance with the properties of a substance which is to be dewatered, and it is easy with such existing dewatering method to dewater a substance to a water content of from 80 to 90%. Accordingly, if the press-dewatering means by a rigid porous material according to the present invention is incorporated at the downstream side of an existing vacuum dehydrator, belt press dehydrator or the like, it is possible to readily carry out highly efficient dehydration which enables a water content of 60% or less to be reached.

Figure 21:
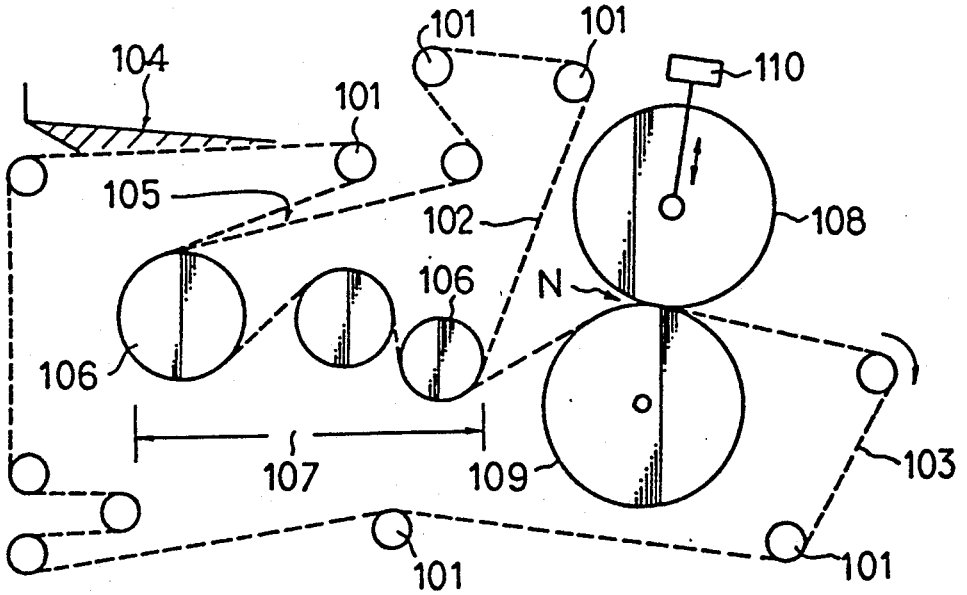
FIG. 21 is a view illustrating a eighth embodiment of the present invention.

FIG. 21 is a view illustrating a belt press type dehydrator in accordance with an eighth embodiment of the present invention. In this embodiment, the filter cloth belts 102 and 103 are separated from each other at the upstream side of the press rolls 108 and 109 utilizing a rigid porous material, and one filter cloth belt 103, together with a sludgy substance to be dewatered, passes through the area between the press rolls 108 and 109. The action of this embodiment is substantially similar to that of the belt press type dehydrator shown in FIG. 20.

Figure 22:
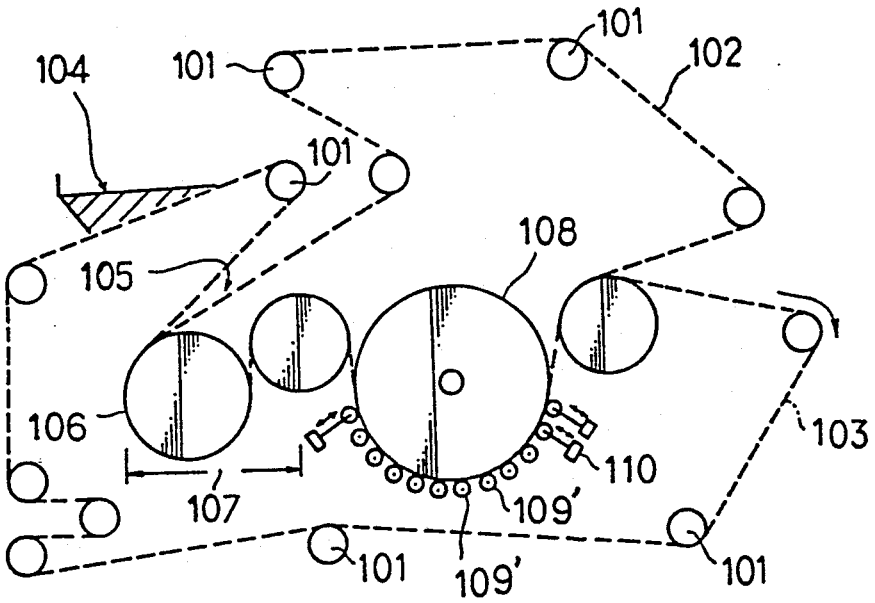
FIG. 22 is a view illustrating a ninth embodiment of the present invention.
Figure 23:
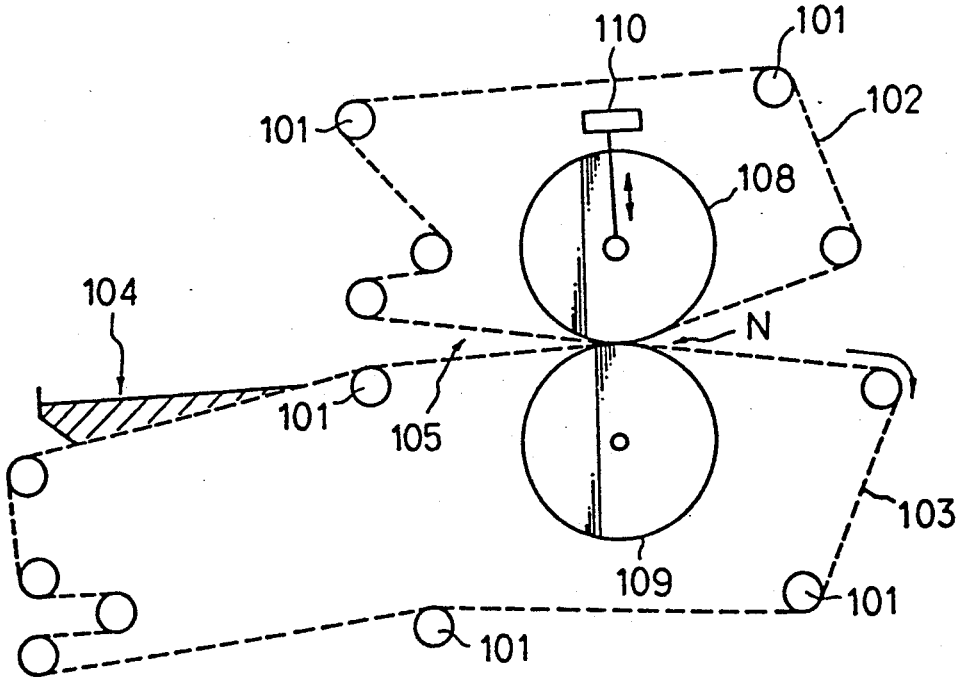
FIG. 23 is a view illustrating a tenth embodiment of the present invention.

FIG. 22 is a view illustrating a belt press type dehydrator in accordance with a ninth embodiment of the present invention. In this embodiment, the press rolls 108 and 109 shown in FIG. 20 are replaced by a press roll 108 defined as a dewatering roll having its surface formed from a rigid porous material and a multiplicity of pressure rolls 109' for applying pressing force to a substance to be dewatered. In FIG. 22, a sludgy substance to be dewatered is sandwiched between the filter cloth belts 102 and 103 and pressed by the press roll 108 and the pressure rolls 109'; in this case, the filter cloth belt 102 on the press roll 108 side may be omitted. FIG. 23 is a view illustrating a belt press type dehydrator in accordance with a tenth embodiment of the present invention. In this embodiment, the primary press section 107 in the belt press type dehydrator shown in FIG. 20 is omitted, and therefore this embodiment is suitable for use in the case where a sludgy substance supplied so as to be dewatered has a relatively low water content.

Figure 24:
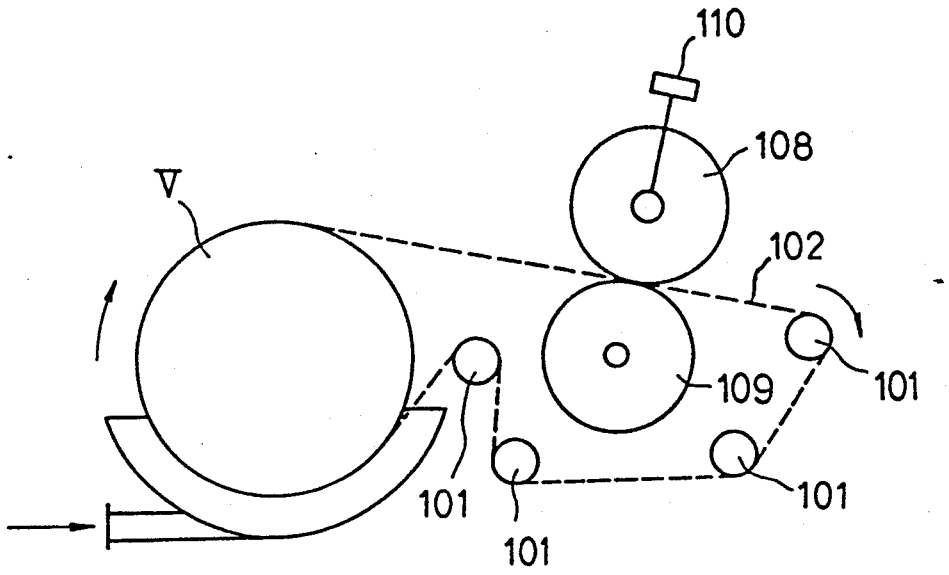
FIG. 24 is a view illustrating a eleventh embodiment of the present invention.

FIG. 24 is a view illustrating a dehydrator in accordance with an eleventh embodiment of the present invention. This embodiment is arranged such that the above-described press roll 108 defined as the dewatering roll using a rigid porous material is incorporated at the downstream side of an existing vacuum dehydrator V.

Figure 25:
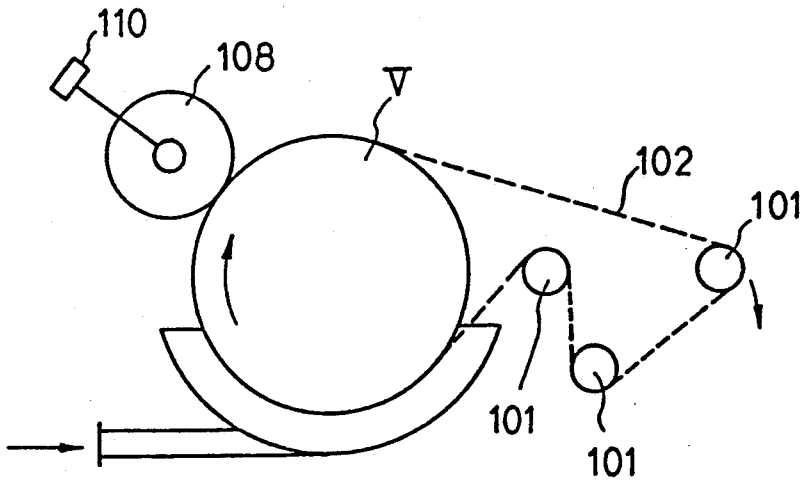
FIG. 25 is a view illustrating a twelfth embodiment of the present invention.

FIG. 25 is a view illustrating a dehydrator in accordance with a twelfth embodiment of the present invention. This embodiment is arranged such that the above-described press roll 108 defined as the dewatering roll using a rigid porous material is brought into direct contact with a vacuum dehydrator V.

Figure 26:
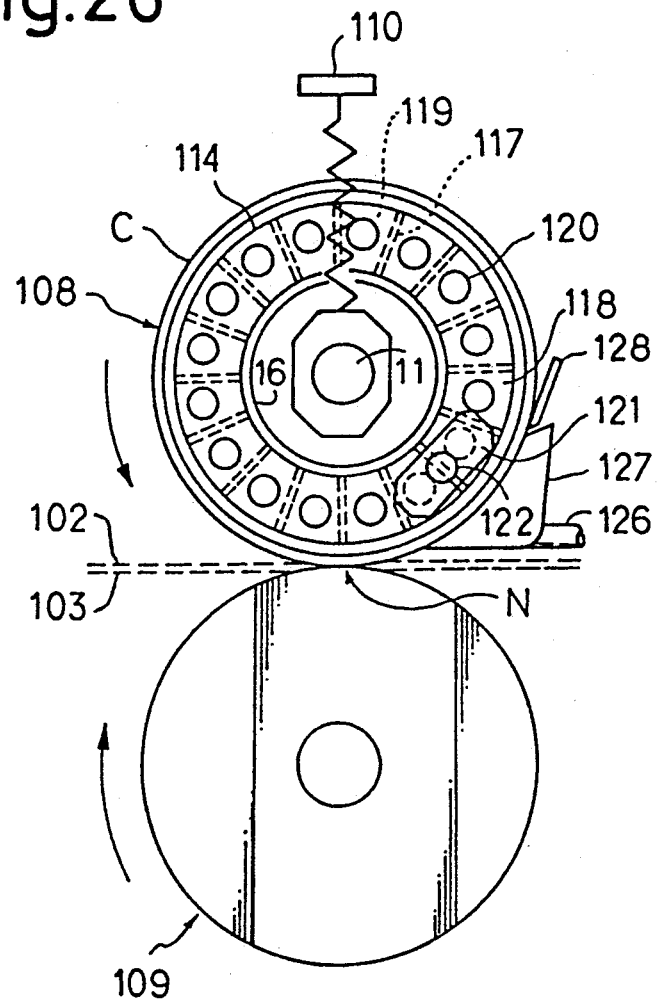
FIG. 26 is a side view illustrating an essential part of the seventh and ninth embodiments.

FIG. 26 is an enlarged view of an essential part of the belt press type dehydrator shown in FIGS. 20 and 23. A substance to be dewatered such as sludge which is sandwiched between the filter cloth belts 102 and 103 is transported to the nip portion N, where water inside the substance to be dewatered is squeezed by pressing. The squeezed water is rapidly absorbed by virtue of the capillary action of the rigid porous material C.

When the water in a substance to be dewatered such as sludge is squeezed by pressing and absorbed by the capillary action of the rigid porous material C in the way described above, the substance becomes dewatered cake which is then separated from the nip portion N and transported. As the press roll 108 defined as the dewatering roll further rotates, pressurized air is supplied into air supply chambers 119 through air supply bores 120 from a pressurized air inlet pipe 122 through a pressure plate 121 which is slidably engaged with a side plate 118 of the roll 108. The pressurized air is jetted out into the rigid porous material C from the side of an outer casing 114 which is opposite to the water absorbing side through small bores and grooves (see FIGS. 3 and 4) formed in the outer casing 114, thus causing water absorbed and retained by the rigid porous material C to be discharged into a discharge tank 127. In this way, the capillary tubes of the rigid porous material C are regenerated to a state wherein they possess no water.

Further, among the water discharged from the rigid porous material C, water adhering to the surface of the material C is scraped off by a doctor blade 128 and collected into the discharge tank 127. Since scraping of water by the doctor blade 128 is carried out in the capillary regeneration region where the pressurized air is jetted out, there is no fear of the water scraped off by the doctor blade 128 being absorbed by the capillary tubes of the rigid porous material C again, and when the material C reaches the nip portion N by rotation, it can absorb, without any hindrance, water squeezed from a substance to be dewatered by pressing. The water collected in the discharge tank 127 is discharged to the outside through a discharge pipe 126.

As described above, as the press roll 108 defined by the dewatering roll rotates, a substance to be dewatered which is sandwiched between the filter cloth belts 102 and 103 is pressed between the press rolls 108 and 109 to squeeze water inside the substance, and the squeezed water is absorbed by the capillary action of the rigid porous material C provided on the press roll 108, and subsequently the water retained by the capillary tubes is discharged to regenerate the capillary tubes. By continuously repeating the above-described series of actions, that is, press dehydration, water absorption and retention and the capillary regeneration, a substance to be dewatered such as sludge is continuously dewatered and transported to the outside in the form of dewatered cake.

Further, more effective dehydration can be carried out by using electroendosmosis and pressure filtration, which have already been developed, in combination with the dehydrators according to the present invention. More specifically, in each of the above-described embodiments, the surface of the press roll 108 defined by the dewatering roll is formed from an electrically conductive rigid porous material, and a voltage is applied between this rigid porous material, employed as a cathode, and the other press roll 109 to apply an electroendosmotic action generated due to a resultant potential difference, so that water inside a sludgy substance to be dewatered is forced to move toward the rigid porous material by the electroendosmotic action, thereby causing acceleration of absorption of water by the capillary action of the rigid porous material.

Figure 27:
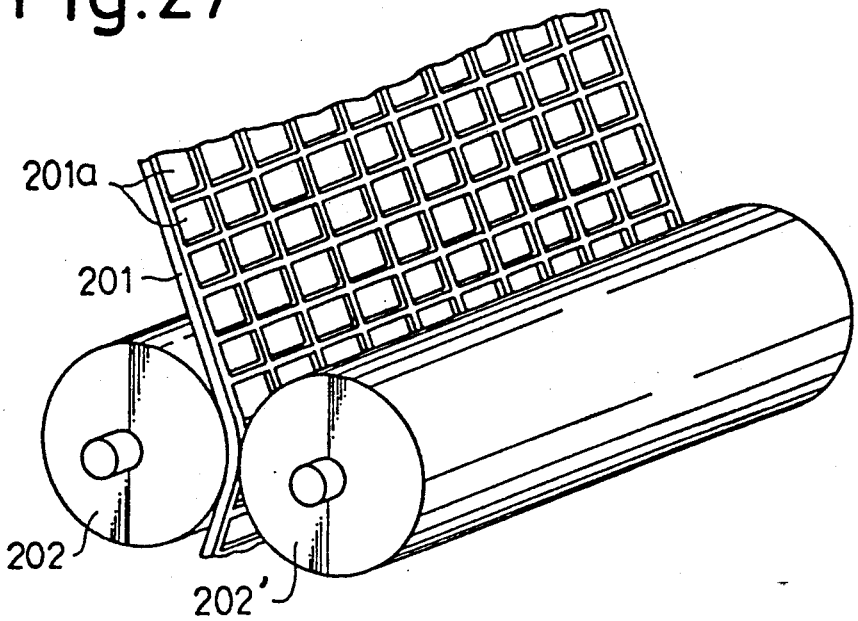
FIG. 27 is a conceptional perspective view illustrating a thirteenth embodiment of the present invention.
Figure 28:
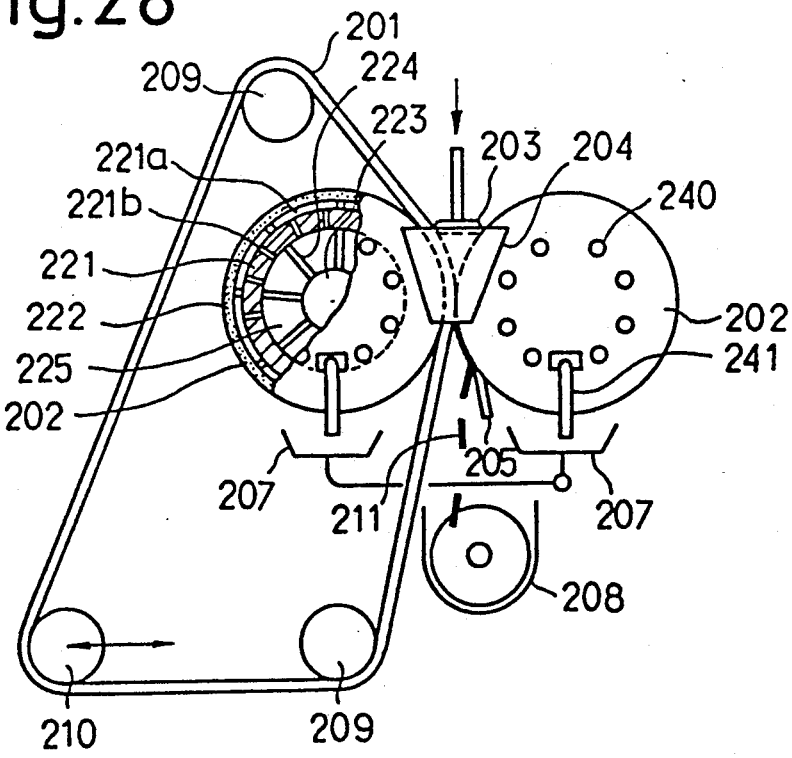
FIG. 28 is a sectional view illustrating the thirteenth embodiment of the present invention.

FIG. 27, which illustrates a thirteenth embodiment of the present invention, is a perspective view conceptionally showing a press-dewatering apparatus employing a perforated belt in the form of a flexible frame member, and FIG. 28 is a sectional side view of the press-dewatering apparatus shown in FIG. 27.

In the figures, the numeral 201 denotes a perforated belt made of a resilient material and provided with a multiplicity of rectangular holes **201*a* as shown in FIG. 27. The perforated belt 201 has substantially the same width as the length of a pair of press rolls 202 and 202' pressed against each other, and is stretched by guide rollers 209, a tension roller 210 and the like in such a manner that the belt 201 passes through the area between these press roll 202 and 202' and surrounds part of one press roll 202**.

Each of the pair of press rolls 202 and 202' consists of an outer casing 221 having a multiplicity of circumferential grooves **221*a* and a multiplicity of radial small bores 221*b* extending through the casing 221 so as to be communicated with these grooves 221*a*, and a rigid porous material 222 covering the outer periphery of the outer casing 221. The outer casing 221 is rigidly secured to a shaft 223 through ribs 224 which are disposed radially. The ribs 224 are discontinuously provided so as to equally divide the area between the shaft 223 and the outer casing 221, the ribs 224 extending in the axial direction of the shaft 223. Both axial ends of the ribs 224 are closed by side plates to define discharge chambers 225 between the shaft 223 and the outer casing 221. Discharge bores 240 are provided in the side plate defining one side of each of the discharge chambers 225, the discharge bores 240 being adapted to be communicated with a discharge pipe 241** at the lowest point.

The numeral 203 denotes a supply tank for a substance to be dewatered such as sludge. A substance to be dewatered which is supplied to the supply tank 203 under a predetermined pressure by a pump (not shown) or the like is filled into the holes 201*a* in the perforated belt 201 and pressed together with the belt 201 while passing through the area between the pair of press rolls 202 and 202'. Water which is squeezed from the dewatered substance by the pressing is retained by the rigid porous materials 222 by the capillary action as described later in detail. The dewatered substance having water squeezed therefrom in this way adheres in the form of dewatered cake to the press roll 202' having a rougher surface and is then discharged by means of a doctor blade 205. In the figure, the numeral 204 denotes a side seal, and the numeral 207 drain tanks.

When no water is held in its capillary tubes, the rigid porous material 222 possesses water absorbing and retaining action to rapidly absorb and retain water, but when the capillary tubes are filled with water, the material 222 has only the water retaining action to retain the water in the capillary tubes. Accordingly, although the rigid porous materials 222 provided on the press rolls 202 and 202' rapidly absorb the water squeezed from a substance to be dewatered at the time of starting, that is, when the capillary tubes are not filled with water, the water absorbing action of the materials 222 disappear thereafter, and the absorbed water is retained in the rigid porous materials 222 by the water retaining action. The water retained in the porous materials 222 is replaced by water which is subsequently squeezed from the substance to be dewatered and which is forced into the materials 222. More specifically, the substance to be dewatered filled in the holes 201*a* of the perforated belt 201 is pressed by the pair of press rolls 202 and 202' to squeeze water from the substance, and the squeezed water is forced into the rigid porous materials 222, whereby water which has already been retained is discharged to the outside and replaced by the water forced into the materials 222.

The water replaced and discharged from the rigid porous materials 222 as described above is led into the discharge chambers 225 through the grooves 221*a* and the small bores 221*b* and collected into the drain tanks 207 through the discharge bores 240 and the discharge pipes 241.

It should be noted that the press-dewatering apparatus shown in FIG. 28 may be provided with a capillary regenerating means employing pressurized air in a manner similar to that in the dehydrator shown in FIG. 1 in order to regenerate the capillary tubes of the rigid porous materials 222 provided on the press rolls 202 and 202'.

When a porous ceramic is employed as the rigid porous material 222, the porosity thereof is preferably selected to be from 30% to 60% for the purpose of maintaining strength, and the pore diameter is preferably from 0.5 to 350 μm, more preferably from about 1 to about 200 μm, in consideration of the speed of water absorption and the separability of dewatered cake, although the preferable range depend upon the kind of substance to be dewatered. However, when the adhesion of the substance to be dewatered is relatively large, it is preferable to employ a double-layer material having a thin film on the surface thereof, the film having a pore diameter of from 1 to 30 μm.

Figure 29:
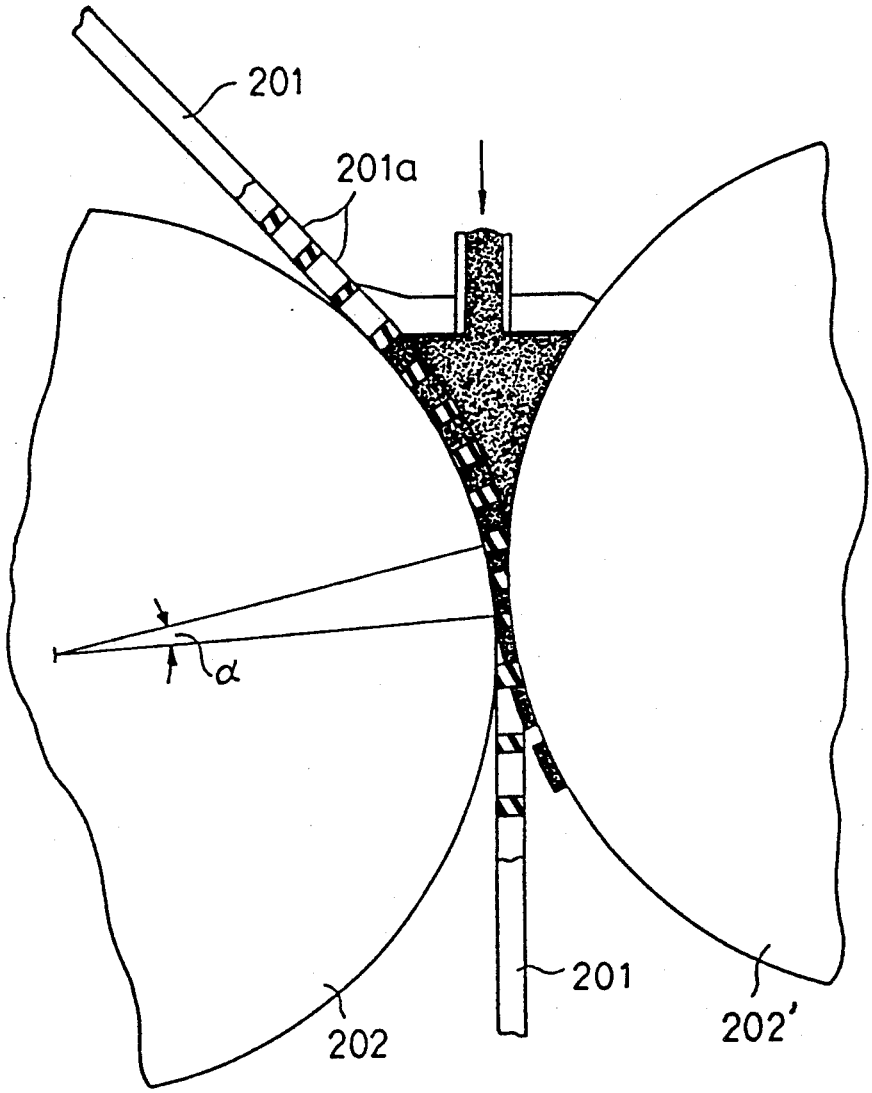
FIG. 29 is a view employed to describe the operation of the thirteenth embodiment.
Figures 30A, 30B:
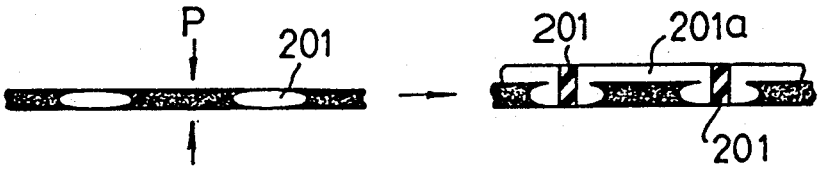

FIG. 29 is an fragmentary enlarged sectional view of an essential part of this embodiment, which shows the way in which this embodiment operates As illustrated, the pressing range within which the pressing force by the press rolls 202 and 202' acts on a substance to be dewatered is defined by an angle $\alpha$ which is made between a point at which the peripheries of the holes 201*a* in the perforated belt 201 come into contact with the press rolls 202 and 202' at the same time and a line (the nip portion) which intersects the centers of both the press rolls 202 and 202'. Therefore, at the same time as the substance to be dewatered is pressed, the perforated belt 201 is also pressed as shown in FIG. 30(A), and the belt 201 is thereby crushed flat. However, since the perforated belt 201 is retained by means of frictional force occurring between the press rolls 202 and 202', it is difficult for the perforated belt 201 as a whole to be deformed in the planar direction.

Further, when the perforated belt 201 crushed flat during pressing is restored to its original form after passing the nip portion, the perforated belt 201 is separated from the periphery of the dewatered substance as shown in FIG. 30(B), and therefore dewatering cake is readily separated from the perforated belt 201.

Figures 31A, 31B, 31C, 31D:
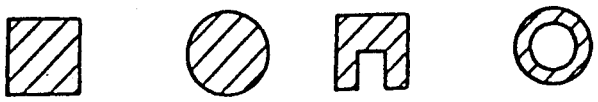
FIGS. 30(A), 30(B) and 31(A) to 31(D) are sectional views each illustrating an essential part.

For the purpose of the above-described separation of dewatered cake from the perforated belt 201 and applying a sufficient pressing force to the substance to be dewatered, the perforated belt 201 is preferably formed from a material which is readily deformed by compression, and as a material for constituting the perforated belt 201 it is preferable to employ a rubber having a hardness (Hs) of 50 or less or a hollow rubber such as that shown in FIG. 31(D). It should be noted that a rib portion defining each peripheral portion of the perforated belt 201, that is, a flexible frame member, may have a cross-sectional configuration such as those shown in FIGS. 31(A) to 31(C) in addition to the above-described hollow shape.

According to this embodiment, a substance to be dewatered is restrained by the perforated belt 201 and pressed by the pair of press rolls 202 and 202', and therefore it is possible to obtain a strong pressing force, i.e., from 50 to 100 kg/cm$^2$.

Figure 32:
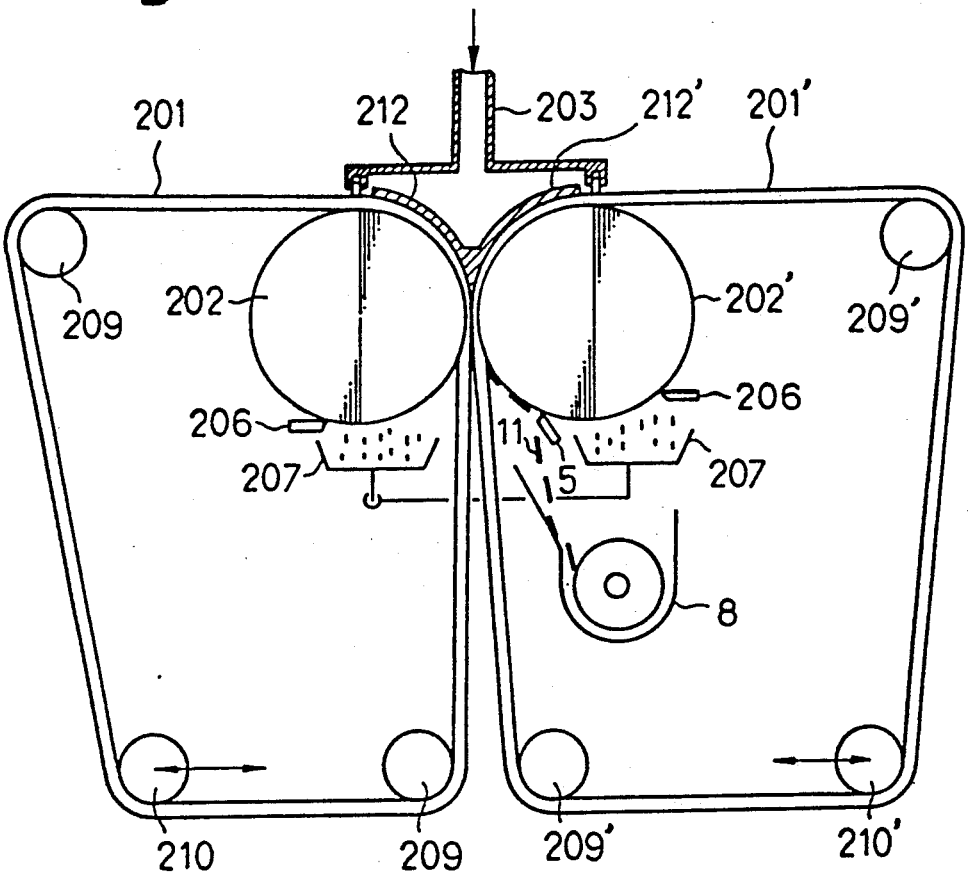
FIG. 32 is a sectional view illustrating a fourteenth embodiment of the present invention.

FIG. 32 is a sectional view of a press-dewatering apparatus showing a fourteenth embodiment of the present invention. It is assumed that, in the figure, the same symbols as those shown in FIG. 28 denote the same or similar portions.

In this embodiment, perforated belts 201 and 201' are stretched by guide rollers 209, 209' and tension rollers 210, 210' in such a manner that the belts 201 and 201' pass through the area between a pair of press rolls 202 and 202' and surround the rolls 202 and 202', respectively, and in addition, wedge-shaped press portions 212 and 212' are provided along the respective outer peripheries of the press rolls 202 and 202' in such a manner that the respective spacings between the press portions 212 and 212' and the surfaces of the press rolls 202 and 202' are gradually reduced toward the nip portion. This embodiment is the same as the press-dewatering apparatus shown in FIGS. 27 and 28 in the other points.

Figure 34:
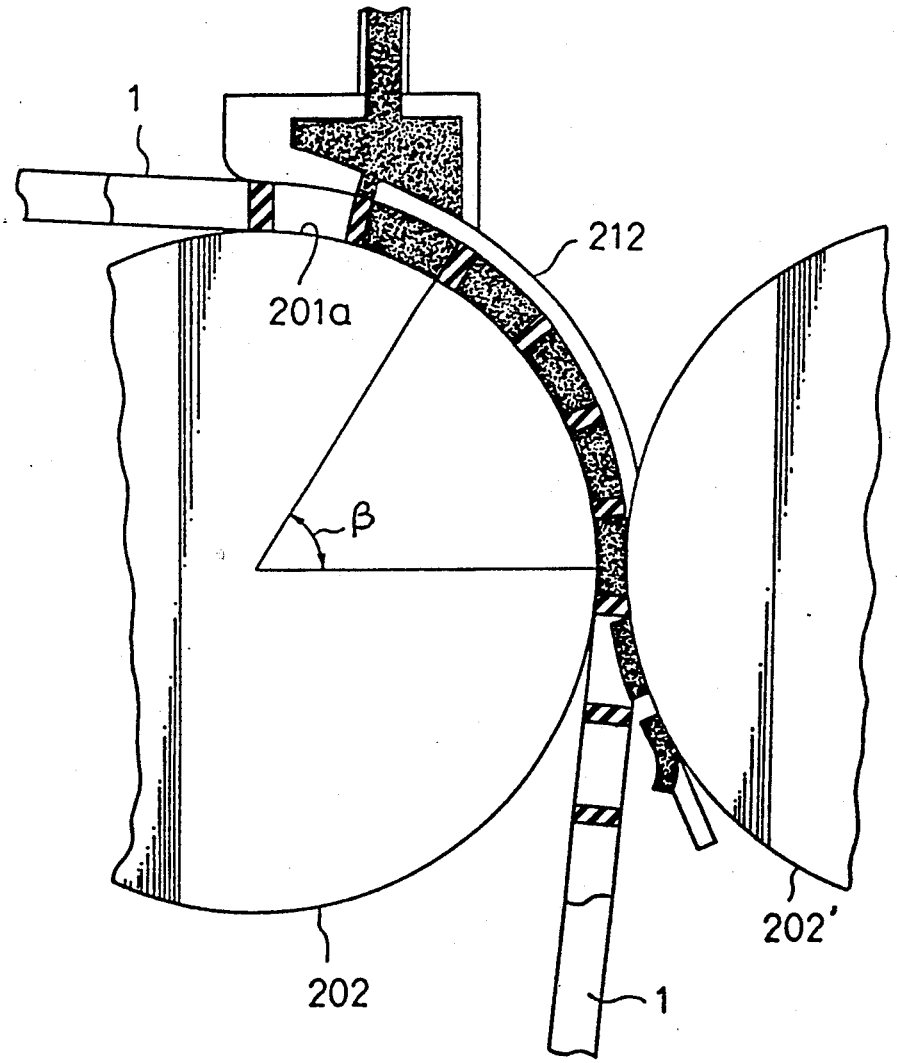
FIG. 34 is a view employed to describe the operation of the fourteenth and fifteenth embodiments.

According to this embodiment, as shown in FIG. 34, a practically effective pressing range is defined by a range (angle $\beta$) from a point where the peripheries of the holes 201*a* in the perforated belt 201 come into contact with the inlet portion (introducing portion) of the wedge-shaped press portion 212 to be center line (nip portion) of the press roll 202. More specifically, in pressing by a pair of press rolls 202 and 202', the range from a point where the flexible frame member defining the holes 201*a* in the perforated belt 201 comes into contact with the press roll 202 to the center of the press roll 202 is relatively small as shown by the angle $\alpha$ in FIG. 29, whereas, in this embodiment, the effective pressing range can be enlarged by providing the wedge-shaped press portions 212 and 212' along the outer peripheries of the press rolls 202 and 202'. It should be noted that the pressing range is enlarged as the diameter of the press roll 202 is increased, but an increase in diameter of the press roll 202 increases the size of the apparatus, and the increase in compression ratio of the perforated belt 201 is limited by the belt strength.

Provision of the wedge-shaped press portions 212 and 212' as described above enables the range of pressing by the press rolls 202 and 202' to be readily enlarged, and application of the wedge-shaped press portions 212 and 212' to other embodiments (for example, the embodiment shown in FIG. 1) employing no perforated belt 201 enables enhancement of the press-dewatering effect.

Further, the configuration of the press portions 212 and 212' for enlarging the pressing range is not necessarily limited to the wedge shape, and it is possible to employ any configuration, provided that the employed press portions have press surfaces for pressing a substance to be dewatered which oppose the respective surfaces of the press rolls 202 and 202' over a predetermined range from the nip portion between the rolls 202 and 202' and the spacing between each press surface and the corresponding roll surface is gradually reduced along the direction of rotation of the rolls (toward the nip portion).

Figure 33:
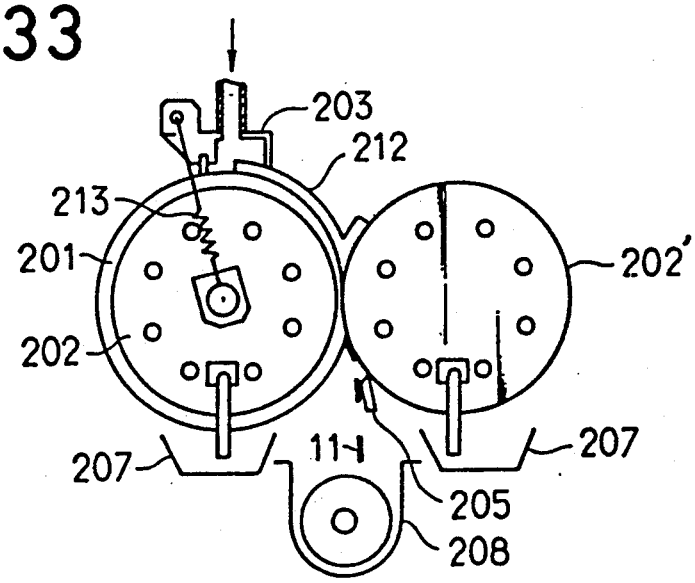
FIG. 33 is a sectional view illustrating a fifteenth embodiment of the present invention.

FIG. 33 is a sectional view of a press-dewatering apparatus showing a fifteenth embodiment of the present invention. In the figure, portions which are the same as or similar to those shown in FIG. 32 are denoted by the same symbols.

This embodiment differs from the press-dewatering apparatus shown in FIG. 32 in that a perforated belt 201 is wound around one press roll 202 of a pair of press rolls 202 and 202', and a wedge-shaped press portion 212 is attached to the press roll 202 alone, and further a supply tank 203 for supplying a substance to be dewatered is provided above the press roll 202. It should be noted that the numeral 213 in the figure denotes a spring for pressing the supply tank 203 against the press roll 202 so that wedge-shaped pressing is reliably effected at the wedge-shaped press portion 212.

Since, according to this embodiment, the perforated belt 201 is wound directly around one press roll 202, there is no need for guide rollers, tension rollers or the like. Accordingly, the size of the apparatus is reduced as compared with the above-described fourteenth embodiment (see FIG. 32). Further, since the press roll 202' is provided for the purpose of pressing the wedge-shaped press portion 212 against the press roll 202 and allowing dewatering cake to be attached to the surface thereof, the diameter of the press roll 202' may be made smaller than that of the illustrated one in comparison with the press roll 202, and the press roll 202' may also be formed from, for example, a material having water impermeability such as a metal.

Figure 35:
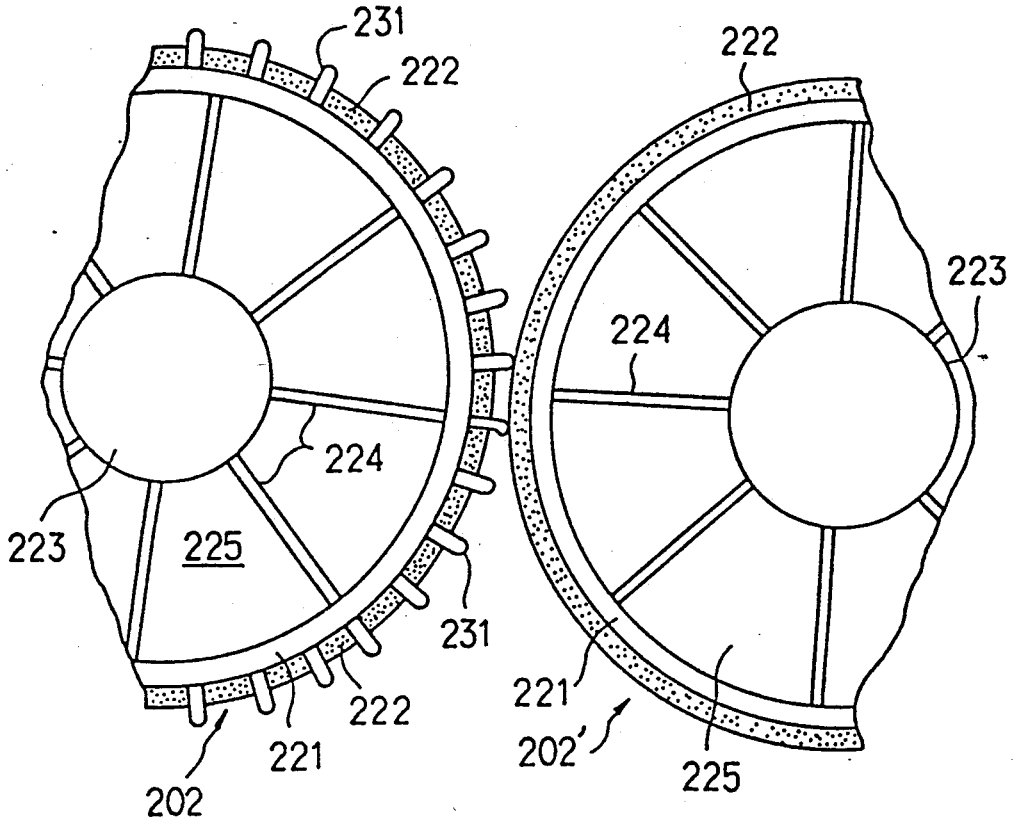
FIG. 35 is a sectional view illustrating a sixteenth embodiment of the present invention.

FIG. 35 is a sectional view of an essential part of a press-dewatering apparatus showing a sixteenth embodiment of the present invention. In the figure, the same symbols as those shown in FIG. 28 denote the same or similar portions.

This embodiment differs from the above-described thirteenth to fifteenth embodiments in that, in this embodiment storage portions for storing a substance to be dewatered are defined by a flexible frame member directly on the peripheral surface of one press roll 202 of a pair of press rolls 202 and 202', whereas, in each of the thirteenth to fifteenth embodiments a perforated belt 201 having a flexible frame member for storing a substance to be dewatered is stretched over each of the press rolls 202 and 202'. More specifically, this embodiment is not different from the thirteenth embodiment shown in FIG. 28 in that a rigid porous material 222 is coated on the outer peripheral surface of an outer casing 221 of each press roll 202, but in this embodiment a flexible frame member 231 defining a multiplicity of cells for forming a multiplicity of storage portions for storing a substance to be dewatered is provided on the rigid porous material 222 in such a manner that the member 231 projects from the surface of the material 222.

Since it is unnecessary, according to this embodiment, to provide the perforated belt 201 as described above, this embodiment is advantageous over the above-described thirteenth to fifteenth embodiments in that there is no fear of the perforated belt 201 being damaged.

It should be noted that it is, of course, possible to appropriately change the configuration of each hole 201*a* in the perforated belt 201 in the above-described thirteenth to fifteenth embodiments and the configuration and number of cells defined by the flexible frame member 213 in the sixteenth embodiment.

Figure 36:
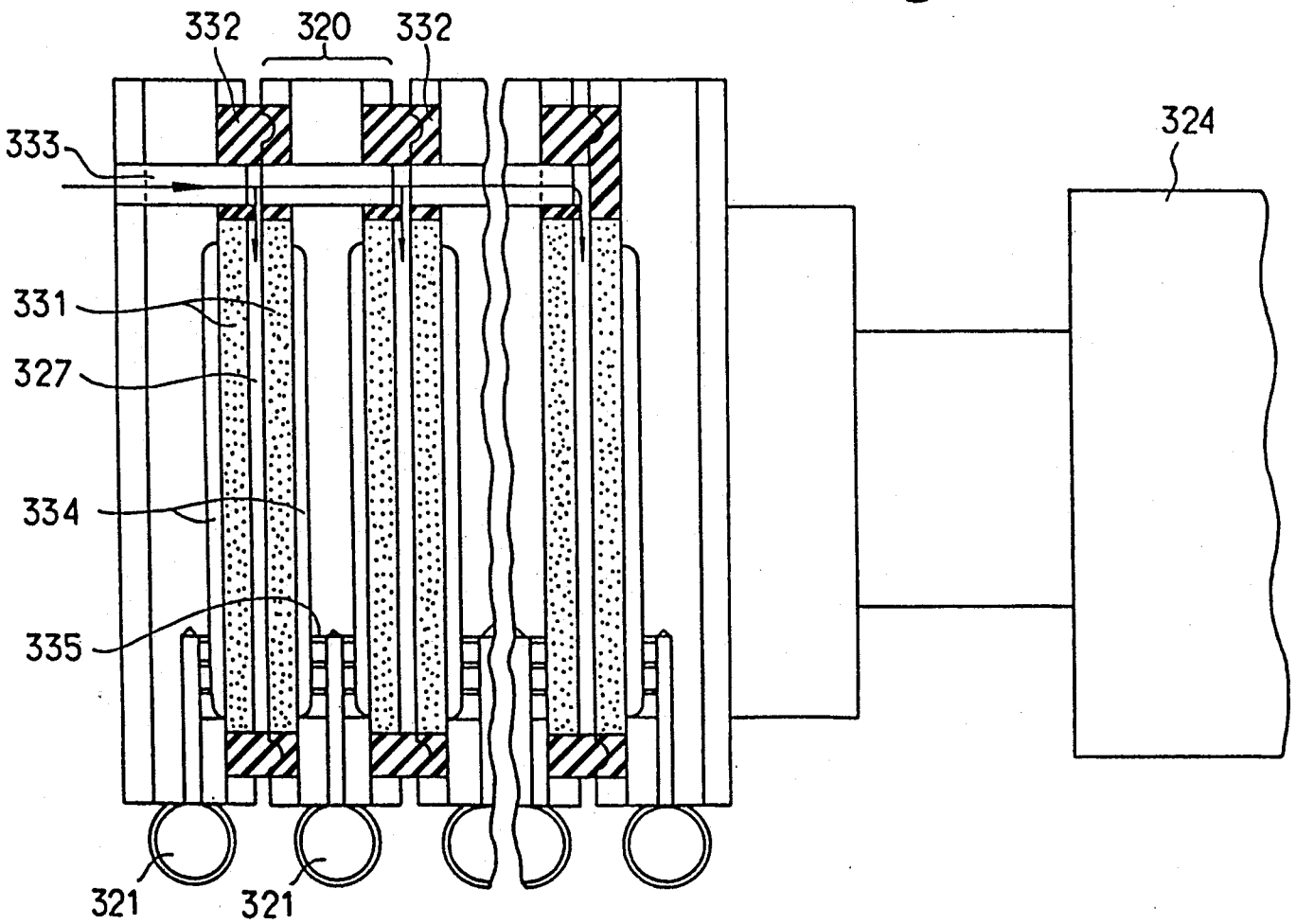

FIGS. 36 to 40 are views illustrating in combination a seventeenth embodiment of the present invention, FIG. 36 being a view schematically showing the general arrangement of the press-dewatering apparatus.

In FIG. 36, a plurality of vertical press plates 320 having pipes 321 for blowout of pressurized air and drainage are disposed horizontally side-by-side, and the press plates 320 are movable horizontally by a hydraulic cylinder 324 so that a substance to be dewatered which is present between the press plates 320 is selectively pressed and released from the press. In addition, a filter chamber 327 is defined between each pair of adjacent press plates 320, and a doctor blade can move vertically within, each filter chamber 327 for the purpose of separating dewatered cake attached to the water absorbing surfaces of the press plates 320 as described later.

Figure 38:
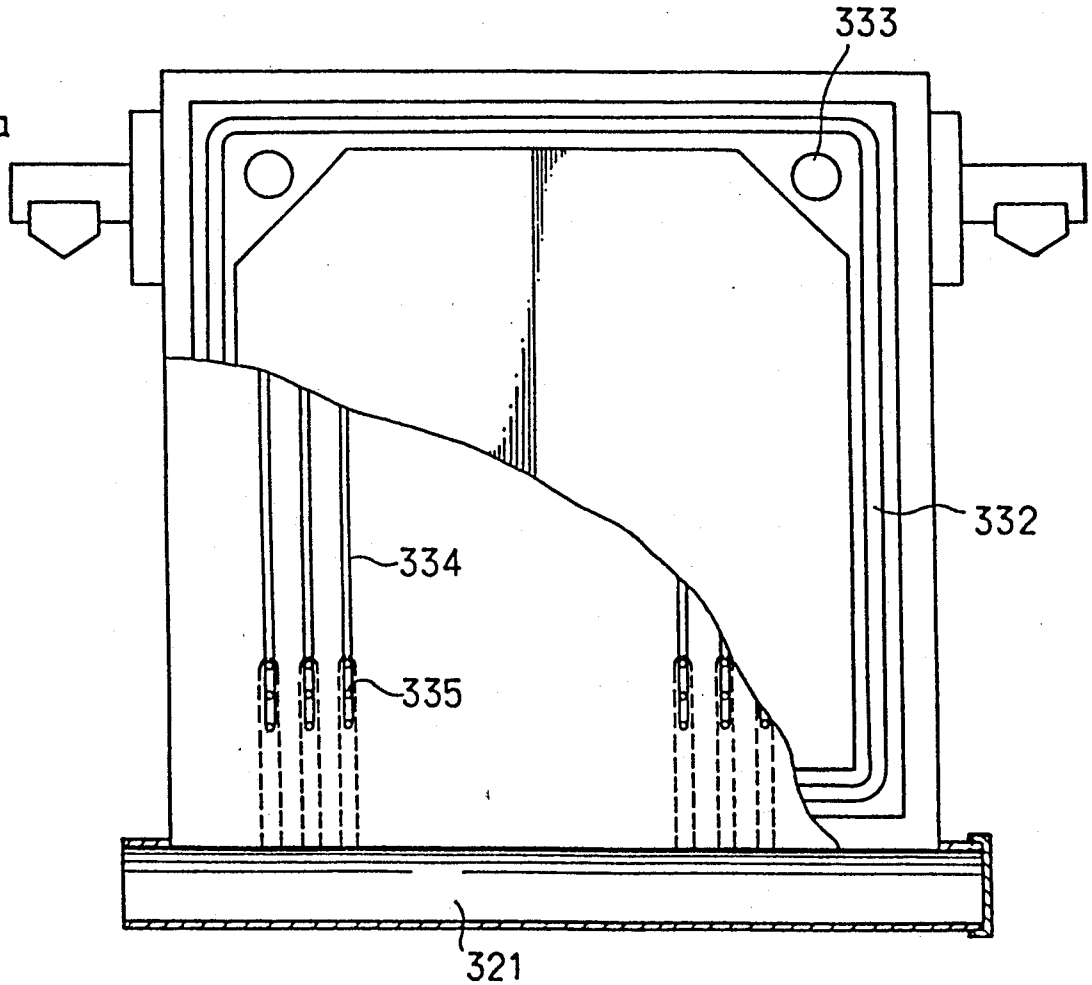
Figure 37:
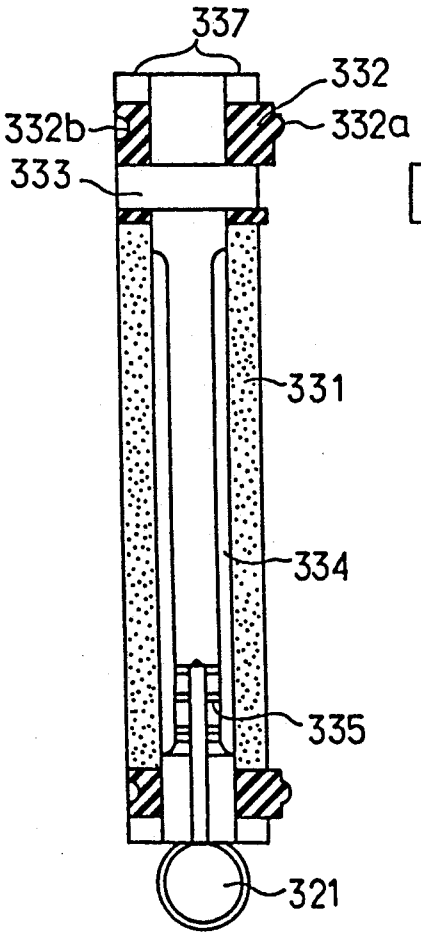

FIGS. 37 and 38 are a side view and a partially-sectioned front view, respectively, of one press plate 320. In the figures, the surface of the press plate 320 is formed from a rigid porous material 331, and a compressible frame 332 is provided in such a manner as to surround the periphery of the rigid porous material 331. Further, the press plate 320 is provided with dewatered substance supply holes 333 for supplying a sludgy substance to be dewatered, for example, sludge, the holes 333 being communicated with the filter chambers 327 when the press plates 320 are set as shown in FIG. 36. In order to define a filter chamber 327 between each pair of adjacent press plates 320, rigid porous materials 331 are stuck to both obverse and reverse surfaces of each of the press plates 320 by means, for example, of bonding except for press plates 320 disposed at the ends.

Further, grooves 334 and bores 335 for defining pressurized air passages or drain passages are provided in the reverse surface of each rigid porous material 331 and communicated with the associated pipe 321 for blowout of pressurized air and drainage. The press plates 320 are movable by means of rails (not shown) laid on both sides thereof.

Further, as described above, the compressible frame 332 is provided between the dewatered substance supply holes 333 and each filter chamber 327, and when the press plates 320 are set, each filter chamber 327 and the dewatered substance supply holes 333 are communicated with each other, whereas, when they are pressed, the filter chamber 327 is shut off from the supply holes 333 by the compressible frame 332 so as to be hermetically sealed. Thus, pressure applied during pressing cannot escape from the filter chamber 327, and the pressing pressure therefore effectively acts on the substance to be dewatered within the filter chamber 327.

It should be noted that, although in the above-described example the compressible frames 332 are provided on both surfaces, respectively, of each press plate 320, it is not always necessary to provide frame members on both surfaces, provided that they are compressible, and the arrangement may be such that a frame member is provided on one side alone so as to come into contact with the body of an adjacent press plate 320 in order to hermetically seal the filter chamber 327.

FIG. 40 illustrates operative states of the press-dewatering apparatus in accordance with this embodiment. First of all, the press plates 320 are spaced apart from each other to set the press-dewatering apparatus as shown in FIG. 40(A).

Figure 40C:
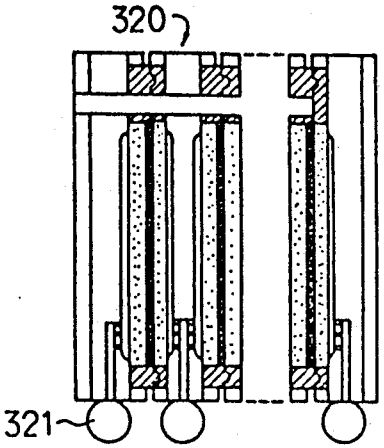
FIGS. 40(A) to 40(F) are views respectively illustrating operative states of the seventeenth embodiment.
Figure 40F:
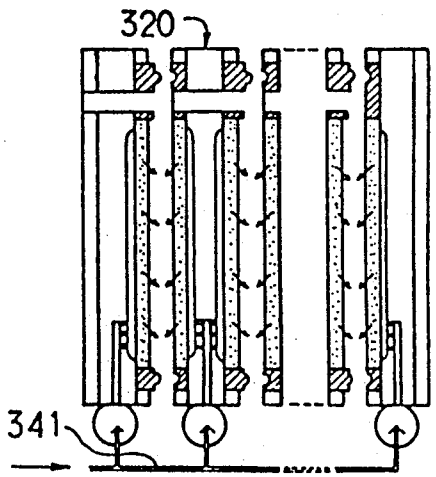
Figure 40B:
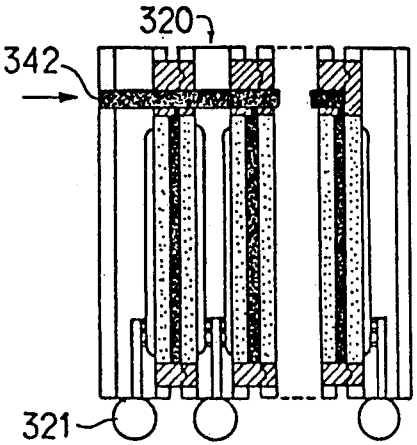

Then, a sludgy substance 342 to be dewatered such as sludge is supplied to each filter chamber 327 from the dewatered substance supply holes 333 as shown in FIG. 40(B).

Subsequently, as shown in FIG. 40(C), the press plates 320 are pressed and tightened by the hydraulic cylinder 324. In consequence, the dewatered substance supply holes 333 and the filter chambers 327 are shut off from each other by the associated frames 332 as described above, so that the pressing force effectively acts on the substance to be dewatered and the substance is thereby pressed.

Figure 40E:
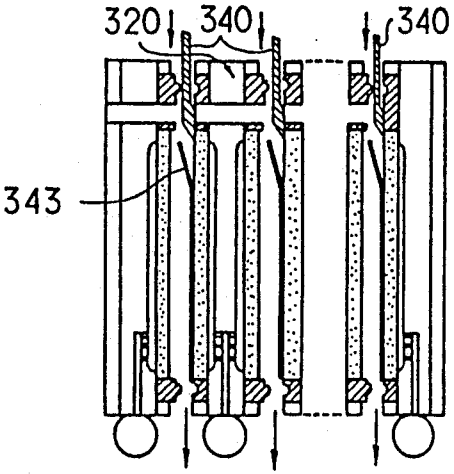
Figure 40A:
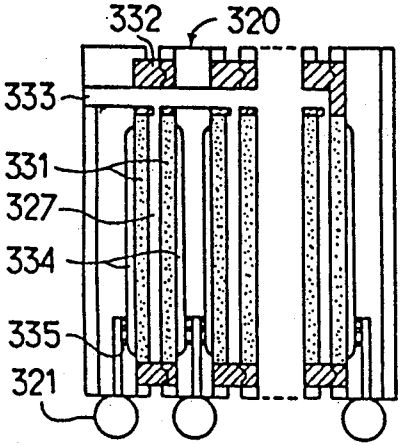
Figure 40D:
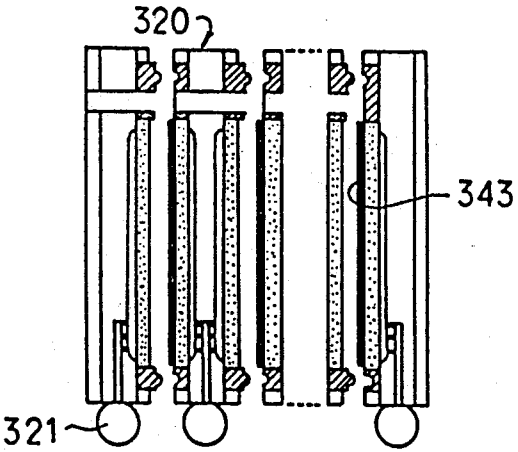

Then, when tightening by the hydraulic cylinder 324 is cancelled, the compressible frames 332 are separated from each other at a predetermined distance as shown in FIG. 40(D). By making the surface roughnesses of rigid porous materials 331 different from each other, dewatered cake can be attached to the press surface of the same rigid porous material 331 at all times. More specifically, dewatered cake adheres to a rigid porous material having a relatively large surface roughness rather than to a rigid porous material having a relatively small surface roughness. It is also possible to cause dewatered cake to adhere to the press surface of the same rigid porous material 331 at all times by making the mean pore diameters in the respective press surfaces of rigid porous materials, 331 different from each other. In other words, dewatered cake adheres to a rigid porous material 331 having a relatively large mean pore diameter rather than to a rigid porous material having a relatively small mean pore diameter.

Then, as shown in FIG. 40(E), the doctor blades 340 are lowered into the filter chambers 327, respectively, to separate pieces of dewatered cake. The separated dewatered cake drops and is then transported to the outside by a transport means such as a belt conveyor (not shown). At this time, in order to lower the doctor blades 340 along the respective surfaces of the rigid porous materials 331, each frame 332 which is disposed on the side of the corresponding press plate 320 where dewatered cake adheres is made flush with the surface of the rigid porous material 331 or made somewhat concave, whereas each frame, 332 which is disposed on the side where no dewatered cake adheres is made convex. Further, the press plates 320 are opened and closed by the hydraulic cylinder 324, and the press plates 320 are linked together by link plates (not shown) so that, by opening and closing a press plate 320 disposed at one end, all the press plates 320 except for a fixed press plate 320 disposed at the other end are opened and closed.

In the above-described press-dewatering process, the rigid porous materials 331 can be employed as both filter members and water absorbing members. When they are employed as filter members, the pipes 321 are used as drain pipes during press-dewatering, and water is sucked from the rigid porous materials 331 through discharge pipes (not shown) so as to be discharged through the grooves 334, the bores 335 and the pipes 321 in that order. On the other hand, when the rigid porous materials 331 are used as water absorbing members, as shown in FIG. 40(F), after dewatered cake 343 has been separated by the doctor blades 340, pressurized air 341 is blown from the reverse surfaces of the rigid porous materials 331 through the pipes 321, the bores 335 and the grooves 334 to blow out water retained in the rigid porous materials 331, thereby regenerating the capillary tubes.

In the above-described press-dewatering apparatus, it is preferable to employ as the rigid porous material 331 a porous ceramic which is constituted by plate-shaped particles which enable dewatered cake to be separated extremely readily and which have strong capillary action.

Figure 39:
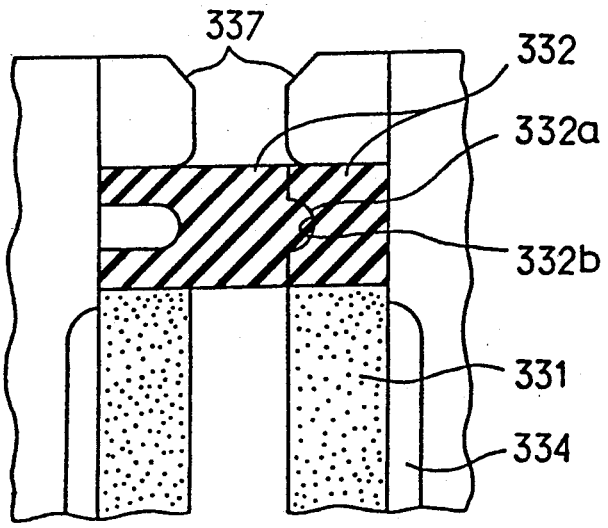

On the other hand, as the compressible frame 332, it is appropriate to employ a rubber material whose hardness (Hs) is from about 20 to about 50 and which has water resistance and small permanent strain. Further, in the above-described embodiment, as shown in FIG. 39, an air gap is defined between frame holders 337 and 337 when frames 332 which are adjacent to each other are connected together for the purpose of enhancing compressibility, and a recess 332*a* and a projection 332*b* are respectively formed on a pair of frames 332 so as to be fitted to each other for the purpose of improving the sealing properties.

Further, the compressible frame holders 337 and 337 may, of course, be designed in various shapes in order to improve sealing properties when the frames 332 are connected together.

As has been described above, it is possible according to the present invention to obtain the following considerably excellent actions and advantages.

(1) A substance to be dewatered is strongly pressed by press members each having its press surface formed from a rigid porous material which has high compressive strength and water absorption and retention properties based on the capillary action to squeeze water from the substance to be dewatered, and the squeezed water is absorbed into the rigid porous material by the capillary action or allowed to replace water which has already been retained thereby with, for example, water pressure produced by pressing, and further the squeezed water is prevented from returning into the dewatered substance by the water retention effected by virtue of the capillary action. It is therefore possible to squeeze water from the substance to be dewatered to an extreme extent, so that the substance to be dewatered is formed into dewatered cake having an extremely low water content. Accordingly, handling and disposal of the obtained dewatered cake are facilitated. The present invention particularly shows high adaptability when used as a secondary dewatering method and apparatus incorporated at the downstream side of an existing dewatering apparatus.

(2) When a sludgy substance is dewatered using the dewatering method and apparatus therefor according to the present invention, it is possible to obtain dewatered cake having an extremely low water content, i.e., 60% or less (a water content according to the conventional method is about 80%, and therefore the water content 60% enables the volume of dewatered cake to be reduced to about ½). Dewatered cake having a water content of 60% or less needs no heavy oil as an assist oil; on the contrary, it is possible to recover energy by dewatering a sludgy substance to be dewatered such as sludge.

We claim:

1. A sewage sludge dewatering apparatus, comprising:

a pair of press members disposed in spaced opposed relation to each other, said press members having on the surfaces thereof which are opposed to the other member a layer of rigid porous material having water absorption and retention properties and a pore size capable of taking up water by capillary action, the pore size at the surface of the material on one of said press members being smaller than the pore size at the surface of the material on the other of said press members, whereby when sewage sludge is positioned between said press members under pressure and water is taken up by the layers of rigid porous material to produce dewatered sludge, the dewatered sludge will adhere to the press member having the larger pore size at the surface thereof;

means for feeding undewatered sludge between said press members;

means associated with the press member having the larger pore size at the surface thereof for peeling off the adhered layer of dewatered sludge; and means operatively associated with said press members for removing from the pores of the layers of material water taken up from the sludge to be dewatered.

2. An apparatus as claimed in claim 1 in which at least one of said press members is a dewatering roll having a shaft on which said dewatering roll is mounted and having a pressurized air supply chamber radially partitioned into at least four equal parts and having a cylindrical member having a plurality of small vent holes surrounding said pressurized air supply chamber, said layer of rigid porous material being around said cylindrical member, and in which said means for removing water from the pores of said layer comprises air supply port means in the parts of said air supply chamber and a pressurized air introducing pipe having means for connecting it to said air supply port means during rotation of said dewatering roll for supplying pressurized air to the respective parts of said air supply chamber.

3. An apparatus as claimed in claim 1 in which at least one of said press members is a dewatering roll having a shaft on which said dewatering roll is mounted and having a suction chamber therewithin and having a plurality of small vent holes opening radially out of said suction chamber, said layer of rigid porous material being around said dewatering roll, and in which said means for removing water from the pores of said layer comprises suction port means in said dewatering roll and suction means connected to said suction port means for exerting suction on said porous material through said vent holes.

4. An apparatus as claimed in claim 1 in which both of said pair of press members is a dewatering roll, said pair of rolls defining a nip section therebetween, and said apparatus further comprises a flexible frame member of compressible material and having a plurality of sludge receiving apertures therein and movable in a path which passes through said nip point for compressing said flexible frame member and sludge contained therein, and means along said path for filling undewatered sludge into said sludge receiving apertures.

5. An apparatus as claimed in claim 4 in which said flexible frame member is a perforated belt.

6. An apparatus as claimed in claim 5 in which said perforated belt is around the peripheral surface of one of said rolls.

7. An apparatus as claimed in claim 5 in which said perforated belt extends along a path spaced from said rolls and extending between the nip point of said rolls.

8. An apparatus as claimed in any one of claims 1–4 further comprising a sludge pressing member having a press surface extending over a predetermined distance along said press members with the distance between the outer surface of said press members and said press surface being gradually reduced in the direction of movement of the sludge between said press members.

9. A dewatering apparatus according to any one of claims 1–4, characterized in that: the mean pore diameter of said rigid porous material is from 0.5 to 350 μm, the porosity thereof is from 20% to 70%, and the compressive strength thereof is 100 kg/cm$^2$ or more.

10. A dewatering apparatus according to any one of claims 1–4, characterized in that: said rigid porous material is a multilayer material whose mean pore diameter changes continuously or stepwisely, said press surface being defined by a surface of said material which has a relatively small mean pore diameter.

11. A dewatering apparatus according to any one of claims 1–4, characterized in that: said rigid porous material is a porous ceramics constituted by plate-shaped particles having a mean aspect ratio of from 2 to 50.

* * * * *